US007632187B1

(12) United States Patent
Farley et al.

(10) Patent No.: US 7,632,187 B1
(45) Date of Patent: Dec. 15, 2009

(54) DEVICE AND METHOD FOR AN ELECTRONIC TAG GAME

(75) Inventors: Brian Farley, Dublin, CA (US); David Small, San Jose, CA (US)

(73) Assignee: Hasbro, Inc., Pawtucket, RI (US)

( * ) Notice: Subject to any disclaimer, the term of this patent is extended or adjusted under 35 U.S.C. 154(b) by 880 days.

(21) Appl. No.: 10/951,025

(22) Filed: Sep. 27, 2004

(51) Int. Cl.
*A63B 67/00* (2006.01)
*A63F 9/02* (2006.01)

(52) U.S. Cl. ..... 463/53; 463/49; 463/50; 463/51; 463/52; 463/54; 434/11; 434/21

(58) Field of Classification Search ..... 463/49–57; 434/11, 21
See application file for complete search history.

(56) References Cited

U.S. PATENT DOCUMENTS 4,545,583 A 10/1985 Pearman et al.
4,695,058 A * 9/1987 Carter et al. ..... 463/5
4,823,401 A 4/1989 Gammarino et al.
5,288,078 A * 2/1994 Capper et al. ..... 463/39
5,426,295 A 6/1995 Parikh et al.
5,571,018 A 11/1996 FitzGerald
5,741,185 A * 4/1998 Kwan et al. ..... 463/51
5,742,251 A 4/1998 Gerber
5,785,592 A * 7/1998 Jacobsen ..... 463/7
5,788,500 A 8/1998 Gerber
5,904,621 A * 5/1999 Small et al. ..... 463/52
5,914,661 A 6/1999 Gross
5,966,226 A 10/1999 Gerber
5,984,788 A 11/1999 Lebensfeld et al.
D433,074 S * 10/2000 Clemmer ..... D21/324
6,174,169 B1 1/2001 Gerber
6,248,019 B1 6/2001 Mudie et al.
6,261,180 B1 7/2001 Lebensfeld et al.
6,270,409 B1 * 8/2001 Shuster ..... 463/20
6,293,869 B1 9/2001 Kwan et al.
6,302,796 B1 * 10/2001 Lebensfeld et al. ..... 463/51
6,398,555 B1 6/2002 Gerber et al.
6,450,816 B1 9/2002 Gerber
6,524,189 B1 * 2/2003 Rautila ..... 463/40
6,569,011 B1 5/2003 Lynch et al.
6,579,097 B1 6/2003 Sampson et al.
6,638,070 B1 10/2003 Healy et al.

(Continued)

FOREIGN PATENT DOCUMENTS

GB 2 153 498 A 8/1995

*Primary Examiner*—John M Hotaling, II
*Assistant Examiner*—Adetokunbo Torimiro
(74) *Attorney, Agent, or Firm*—Perry Hoffman

(57) ABSTRACT

A device combining a gun and target for facilitating a game of tag using infrared light communications between a two or more players is provided. The device includes two infrared transceivers and a shaped housing facilitating handling of the device by a user. The housing includes a grip portion with a finger-operable trigger, a barrel portion and a user-interface including a display and a keypad for programming the device and controlling various game and device functions. A first infrared transceiver transmits a directional infrared signal to another game participant and receives an acknowledgment signal therefrom in response to the transmitted directional signal. A second infrared transceiver facilitates omnidirectional two-way communications between two or more devices. The transceivers facilitate communications between game players before, during, and after a game of infrared electronic tag such as game setup, player identification and gameplay analysis.

37 Claims, 9 Drawing Sheets

U.S. PATENT DOCUMENTS

| | | | | |
|---|---|---|---|---|
| 7,306,523 | B1 * | 12/2007 | Jeffway et al. | 463/51 |
| 7,338,375 | B1 * | 3/2008 | Small | 463/39 |
| 2002/0070881 | A1 | 6/2002 | Marcarelli et al. | |
| 2002/0111201 | A1 | 8/2002 | Lang | |
| 2003/0027103 | A1 | 2/2003 | Preston et al. | |
| 2003/0027640 | A1 * | 2/2003 | Jeffway et al. | 463/49 |
| 2004/0029079 | A1 | 2/2004 | Healey et al. | |
| 2004/0029080 | A1 | 2/2004 | Healy et al. | |

* cited by examiner

BEACON SIGNATURE (TIMES IN MSEC):

* = 1 msec for Data "0", 2 msec for Data "1"

TAG SIGNATURE (TIMES IN MSEC):

* = 1 msec for Data "0", 2 msec for Data "1"

PACKET-TYPE BYTE SIGNATURE (TIMES IN MSEC):

* = 1 msec for Data "0", 2 msec for Data "1"

DATA BYTE SIGNATURE (TIMES IN MSEC):

* = 1 msec for Data "0", 2 msec for Data "1"

CHECKSUM BYTE SIGNATURE (TIMES IN MSEC):

* = 1 msec for Data "0", 2 msec for Data "1"

DEVICE AND METHOD FOR AN ELECTRONIC TAG GAME

FIELD OF THE INVENTION

This invention relates to electronic games, and more particularly, to a device and method for facilitating a game of tag using infrared light communications.

BACKGROUND OF THE INVENTION

As known in the art, infrared electronic games include communication devices for transmission and reception of infrared light signals, operating on the same principle as a remote control for a television. Infrared shooting games typically include two channels of infrared communication, namely, a channel for transmitting an infrared signal (i.e., a tag or shot) and a channel for receiving the transmitted infrared signals. Such infrared electronic shooting games involve two or more players, each equipped with an apparatus for sending infrared signals (e.g., a gun) and an apparatus for receiving infrared signals (e.g., a target), wherein the object of the game is to target and shoot opponents with an infrared signal, thereby scoring a "hit" or a "tag" until only one player or team remains in the game.

Such infrared electronic shooting games are relatively well known and have been available since about 1985. For example, one infrared electronic shooting game sold beginning in about 1986 by WORLDS OF WONDER™, permitted players to fire invisible beams at one another with each player being provided with a game unit for emission of an infrared light beam. In the WORLDS OF WONDER™ game, a target was affixed to each player in order to count the number of "hits" registered by the target associated with each player. In the WORLDS OF WONDER™ game, a player was tagged "out" when six hits were registered for that player. Other infrared electronic shooting games that are known include indoor arena games such as LAZER QUEST™ and the like.

The earliest infrared electronic games had difficulty operating in very harsh environments of direct and indirect sunlight, as well as in the environment of indoor lighting. As disclosed in U.S. Pat. No. 5,904,621 to Small et. al, for "Electronic Game With Infrared Emitter and Sensor," issued May 18, 1999, a series of encoded infrared light signals may be sent with an infrared transmitter for providing a "signature" signal substantially longer in duration than abrupt changes in ambient lighting conditions to facilitate gameplay. The disclosed encoding of infrared signals additionally enabled special game and/or device features. However, although such infrared encoding made games more interesting and/or challenging to the participants, infrared electronic shooting games available for purchase by the general public were somewhat limited in functionality and gameplay in comparison to indoor arena games. Therefore, in view of the foregoing, an improved device and method for an infrared electronic shooting game would be welcome.

Prior art infrared electronic games such as U.S. Pat. No. 4,695,058 to Carter III et. al, for "Simulated Shooting Game With Continuous Transmission of Target Identification Signals," issued Sep. 22, 1987, traditionally operated on two channels of infrared communication. In such systems, one signal was provided for transmitting an infrared signal while another channel received an infrared signal, thereby limiting the amount of data transmitted between two or more game apparatus. It would be desirable for an infrared electronic game to operate on more than two channels of infrared communication to allow for more complex game features and advanced user options to make the game more interactive and challenging.

Furthermore, it would be desirable for the game apparatus to provide an enhanced user interface for more interactivity between players and between a player and apparatus.

SUMMARY OF THE INVENTION

Embodiments of the present invention provide a gun and target device for facilitating a game of tag using infrared light communications between a plurality of players, each player being equipped with a gun and target device.

As described, the gun and target device includes a pistol-shaped housing with a grip portion with a finger-operable trigger button, a barrel portion and a user-interface including a display such a an LCD screen, and a keypad for programming the device and controlling various game functions. The pistol-shaped housing also encases an electronic controller coupled to two infrared transceivers. The first infrared transceiver is positioned at the barrel portion of the gun housing and comprises a directional infrared source and a directional infrared detector, including light lenses for both the source and the detector. The directional infrared source transmits a long-range infrared signal to a remote game participant and the directional infrared detector receives an acknowledgment signal therefrom in response to the long-range signal, indicating a hit.

The second infrared transceiver is positioned within a hemispherical-shaped dome on the top portion of the gun housing and comprises an omnidirectional infrared source and an omnidirectional infrared detector. The omnidirectional source transmits a short-range infrared signal which communicates identity and location data and other data to one or more remote game participants' devices.

The usage of two transceivers enables each gun and target devices to communicate four channels of infrared communication, thus allowing more complex gaming features and advanced user options to make the game more interactive and challenging. The embodiment includes the traditional scheme of communication involving directing a directional infrared signal at an opponent's omnidirectional detector. This action is basis for a "hit" or "tag" being applied to a player. The additional infrared channels allow for more communication (identification, location, statistical and other data) to take place between players before, during, and after a game of infrared electronic tag.

The electronic controller within the gun and target apparatus allows for several modes of gameplay for the players to utilize. Using the LCD screen and user-operable buttons, the player that decides to begin a game of infrared electronic tag (a "host" player) chooses the parameters that will govern the rules of the game. Once determined, these parameters are sent from the host player's gun and target device to the other players' gun and target devices via short-range infrared signal. This wireless communication eliminates errors that might otherwise lead to different players not setting identical parameters on their own device. During gameplay, the infrared communication between devices provide each player with active feedback. For example, a player will be notified by the gun and target device when that player was tagged by an opponent, or whether that player tagged an opponent successfully. A player will be notified by the device whether a targeted remote player is a "friend" or a "foe." A player will be notified when a "foe" is in close range of that player, indicating a proximity warning. The electronic controller stores data during gameplay, including a record of tags received and other performance statistics. After a game of infrared electronic tag, the electronic controllers in each players' devices are able to share stored data about the players' performance during the game.

The gun and target device also includes a device, known as a heads-up-display (HMD), adapted for wearing on the head of a player, the HMD device removably coupled to the pistol-shaped housing. The HMD device includes a transparent eyepiece having a see-through display projected by an optical combiner and partial mirror, thereby allowing the player to acknowledge signals from the gun and target device without taking their attention from the gameplay action.

Briefly summarized, the present invention relates to a device combining a gun and target for facilitating a game of tag using infrared light communications between a two or more players, each player being equipped with the device. The device includes two infrared transceivers and a shaped housing facilitating handling of the device by a user. The housing includes a grip portion with a finger-operable trigger, a barrel portion and a user-interface including a display and a keypad for programming the device and controlling various game and device functions. A first infrared transceiver is disposed at the barrel portion for transmitting a directional infrared signal to another game participant and receiving an acknowledgment signal therefrom in response to the transmitted directional signal. A second infrared transceiver is disposed on the housing to facilitate omnidirectional two-way communications between two or more devices. The transceivers facilitate communications between game players before, during, and after a game of infrared electronic tag such as game setup, player identification and gameplay analysis. Thus, the device operates to enable complex gameplay and advanced user options to make the game more interactive and challenging.

DESCRIPTION OF THE EMBODIMENTS

Figure 1:
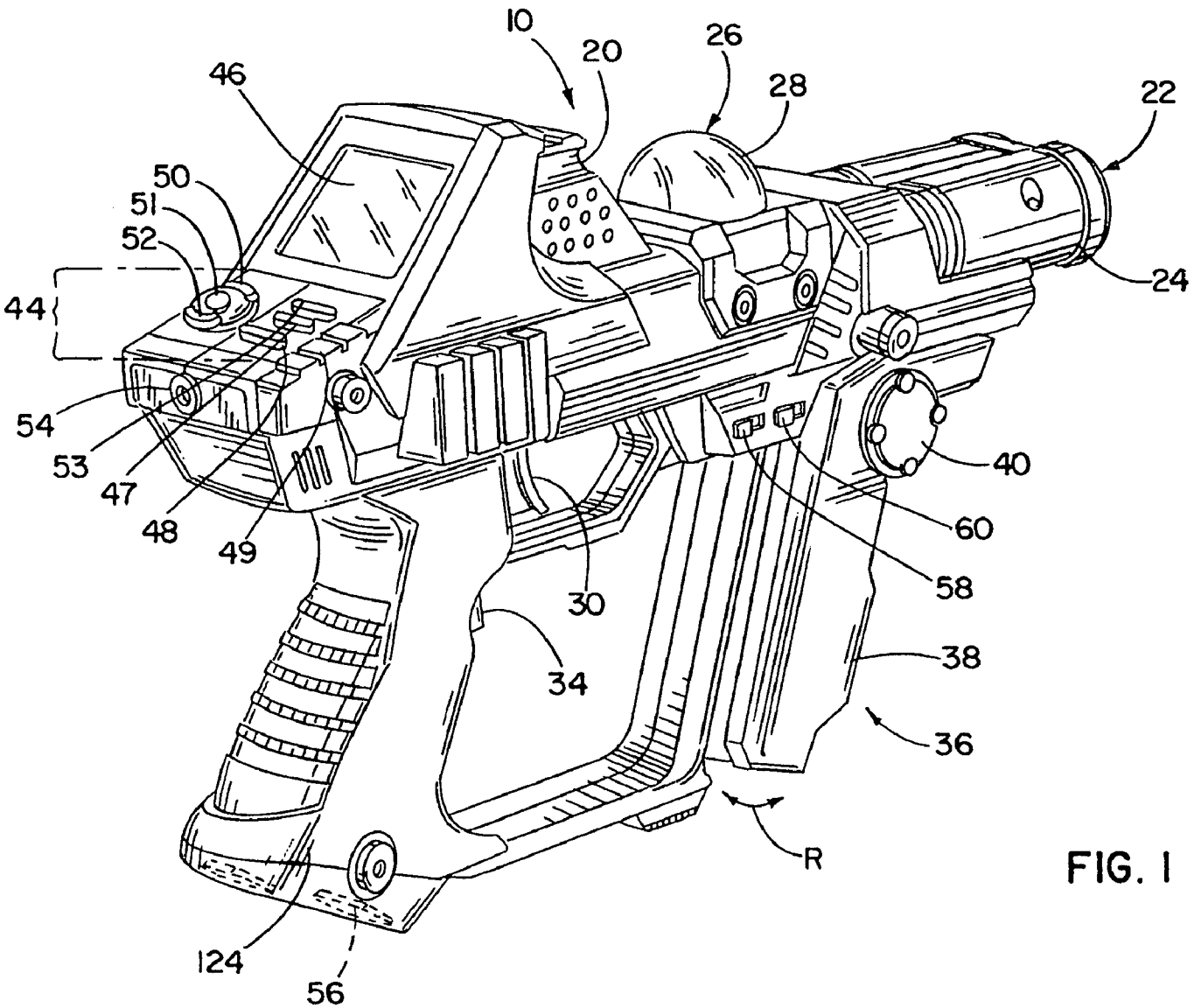
FIG. 1 is a first perspective view of an exemplary infrared shooting game device.
Figure 2:
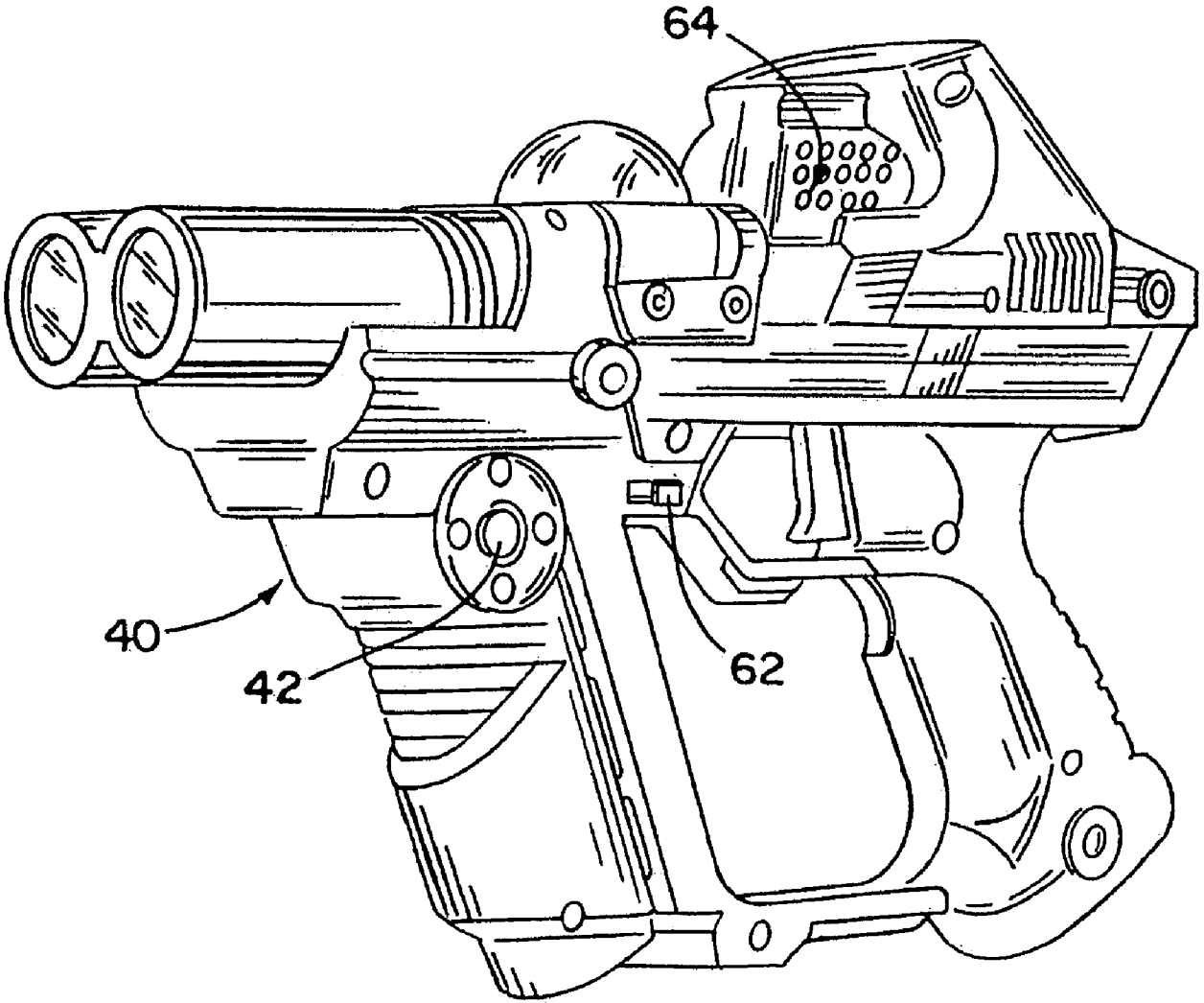
FIG. 2 is a second perspective view of the device of FIG. 1.

Referring now to the drawings and especially FIGS. 1 and 2, an exemplary combination gun and target device for facilitating a game of tag using infrared light communications is shown. The device 10 includes a shaped housing 20, which substantially encloses the device electronics shown in FIGS. 4 and 5. The housing 20 is generally pistol or gun-shaped including a barrel portion 24 with two gun barrels positioned along parallel axis, as depicted in FIGS. 1 and 2. A first lens is disposed at the end of a first barrel and a second lens is disposed at the end of a second barrel. An infrared light source such as a light emitting diode (LED) or the like is disposed behind the first lens within one gun barrel of barrel portion 24 and an infrared detector such as an infrared photodetector or the like is disposed behind the second collimating lens within the other gun barrel of the barrel portion 24. The lenses may be collimating lenses or the like to provide relatively narrow or otherwise focused beams for the infrared diode and narrow field of view for the photodetector. The first and second lenses are disposed adjacently within their respective gun barrels such that the directional infrared source and the directional infrared detector are oriented parallel to each other along the barrel portion 24, providing a directional infrared transceiver 22. The directional infrared transceiver 22 operates to transmit and receive infrared signals in a directional manner. For example, directional transceiver may transmit infrared signals to a remote player's device that is aligned with the barrel portion 24 and receive infrared signals sent from the remote player's device in response to the transmitted signals. The lenses enable the device 10 to transmit and receive infrared signals across distances of several hundred (e.g., three hundred) feet. Various construction techniques may be used to arrange the lenses IR LED's and IR receivers or detectors, for instance the lenses and tubes can be arraigned horizontal or vertical with respect to one another or the two tubes can be combined into one tube. Similarly the columniation of the transmitted light beam and field of view of the receiver could be accomplished using a single lens configuration.

The second infrared transceiver 26 includes an omnidirectional infrared source and an omnidirectional infrared detector. As shown in FIGS. 1 and 2, the housing 20 includes a generally hemispherical-shaped dome 28 positioned on the top surface of the housing 20. The dome 28 is made of an infrared transparent material and encloses the omnidirectional infrared source and the omnidirectional infrared detector. As described hereafter, the omnidirectional infrared source includes an arrangement of infrared light emitting diodes for providing infrared signal transmission approximately 360 degrees about the device 10. Similarly, the omnidirectional infrared detector includes an arrangement of photodetectors within the dome 28 for providing infrared signal reception approximately 360 degrees about the device 10. Additionally, dome 28 may include one or more lenses relative to the omnidirectional source and detector.

The device 10 includes a first finger-operable trigger 30 positioned on a grip portion 124 of the housing. When a player depresses first trigger 30, an infrared signal is transmitted by the directional transceiver 22 in the direction which the gun barrel 24 was aimed. If aligned properly with a remote player's device 10, particularly the omnidirectional transceiver, a "tag" will be applied to that player, the basic object of the game of electronic infrared tag being to tag one's opponents while avoiding being tagged by one's opponents. Further, the grip portion 124 may include a second finger-operable trigger 34 proximate the first trigger 30. The second trigger 34 operates to actuate a "shield" function known in the art so that the device 10 may temporarily ignore tags received from other devices. As shown in FIG. 1, the triggers 30, 34 may be positioned on grip portion 124 in such a way as to be operated in an ergonomic manner by two adjacent fingers of the player's hand gripping the grip portion 124. A second grip portion 36 is positioned forward of grip portion 124 and includes a movable lever 38. Lever 38 may be spring loaded or otherwise biased to arcuately pivot a short distance about cylinder part 40 as shown by double-headed arrow "R". A player operates lever 38 by grasping and squeezing grip portion 36 with the user's second hand thereby actuating a reload function of the device 10 such that the user's supply of infrared ammunition is replenished. This is somewhat analogous to inserting a new clip of ammunition into a gun or quickly reloading the clip. As shown in FIG. 2, function button 42 is positioned on the cylinder part 40 on the left side of the housing 20. Operation of function button 42 is multi-purpose, enabling special device features. For example, a user pressing the function button 42 while pressing trigger 30 may add "mega-tag" points to the next tag transmitted or launched by the device 10. Additionally, by holding both grip portions 124, 36 the user may enjoy better stabilization, aim and control of the device 10.

Located at the rear portion of the housing 20 is a plurality of buttons 48-53 providing a keypad 44. Adjacent the keypad 44 is a display 46, which is angled for facilitating viewing by the user. The keypad 44 and display 46 together provide an interactive, programmable user interface for programming game parameters. The buttons 48-53 allow the user to navigate through options and information among other things displayed on display 46 in the form of a menu-driven interface structure or the like before, during, and after gameplay. Located just below the keypad 44 is a compartment that is closed with a removably-fastened lid 54. The compartment houses the device's power supply, which in an exemplary embodiment includes a plurality of common-sized (e.g., AA) batteries. The compartment may be opened and closed for the purpose of installing and replacing the batteries, which may be disposable or rechargeable. Located on the underside of grip portion 124 are two interfaces or connectors 56. Each connector 56 may be employed to couple an accessory or supplemental device to the device 10. One such accessory that may be removably coupled to the device 10 via connector 56 is a display interface described hereinafter as a heads-up display (HMD) device.

Figure 3:
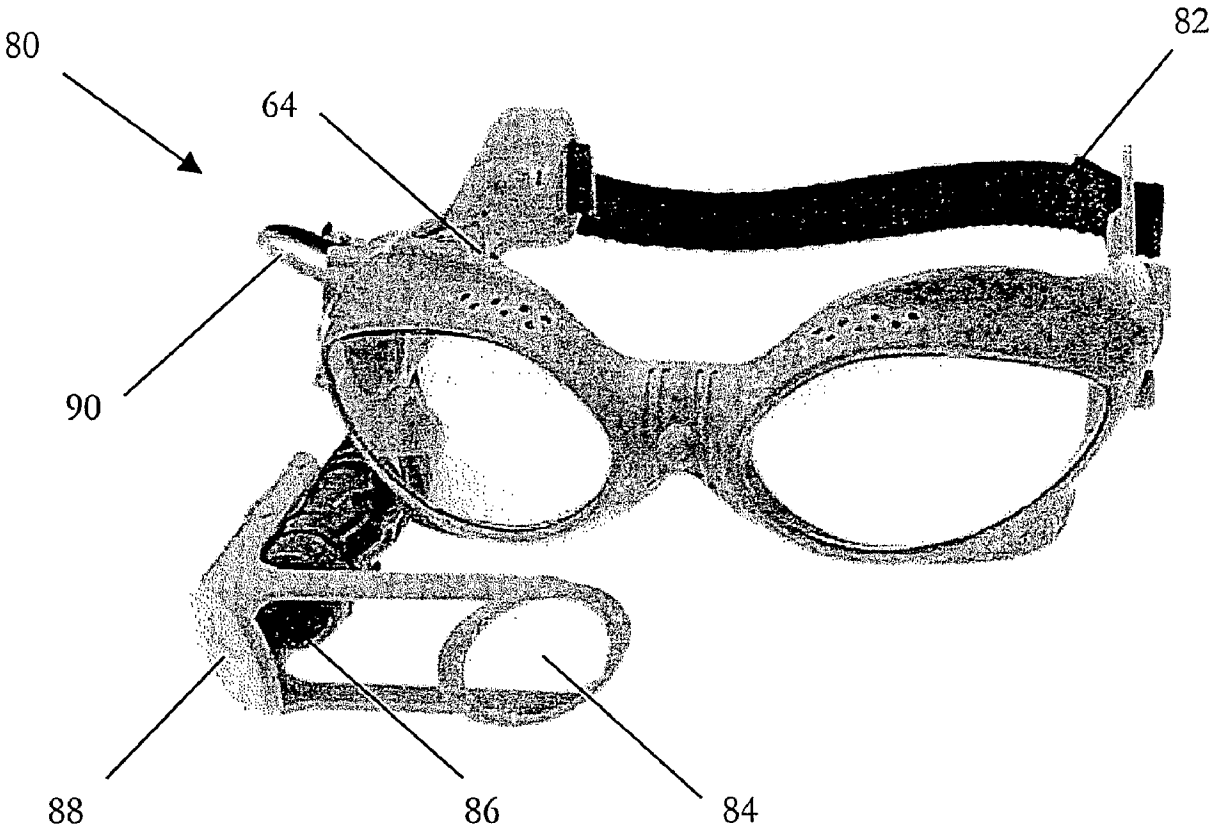
FIG. 3 is a perspective view of an exemplary optional display device for use with the device of FIGS. 1-2.

As depicted in FIG. 3. the HMD device 80 resembles a pair of eyewear such as sunglasses and is designed to fit around a user's head. As is generally known in the art, the HMD 80 is used as a head-mounted optical system allowing the user to enjoy gameplay information in his or her field of view while playing the game. The HMD device 80 includes a mirror 88 and a combiner 84 in order to "wrap" an optical display around the side of the user's head. An adjustable fastening strap 82 fits around the back of a user's head, such that the user looks through the lenses of the glasses and the see-through combiner 84 that is oriented in front of the glasses for viewing. Optical projector 86 is oriented along the side of the user's head and projects an iconic display or the like to facilitate non-line-of-sight communications with other game participants and the like. The HMD 80 may communicate with the device 10 via a cable (not shown) that may be removably attached to the connector 56A.

An Indoor/Outdoor switch 60 is located on right side of the housing 20 near grip portion 36, as shown in FIG. 1. The Indoor/Outdoor switch 60 decreases the intensity of the tag signature for use of the device 10 indoors where ambient infrared energy is not a significant factor to affect transmission and receipt of infrared signals. A HMD Brightness switch 58, located just behind switch 60, controls the brightness of the HMD display. The speaker switch 62, located on the left side of the housing 20 (FIG. 2) near grip portion 36, toggle enables and disables the audio speaker 64 (earpiece) of the device 10 to produce and silence respectively audible cues, sound effects and the like produced by the speaker 64.

Figure 4A:
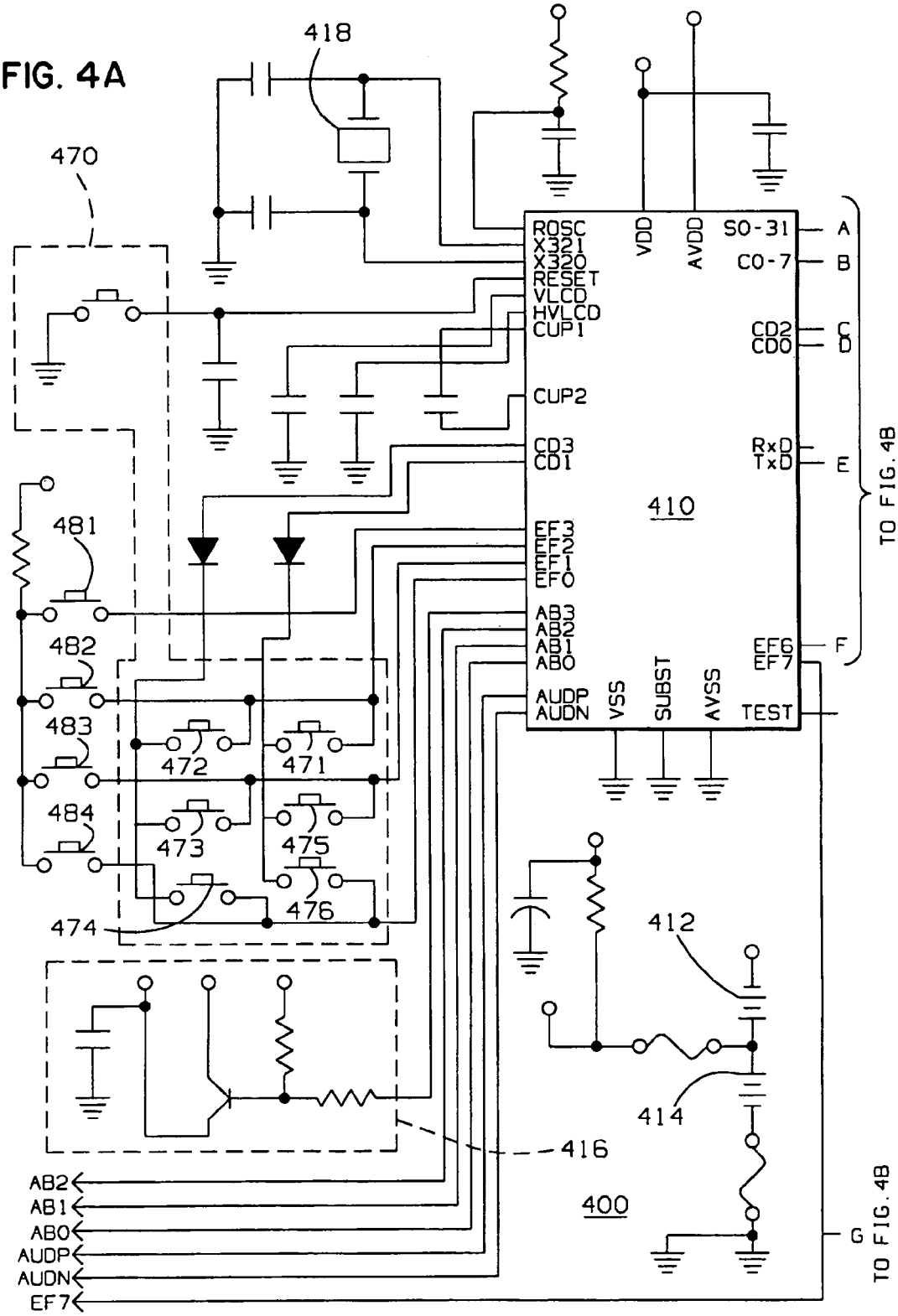
FIGS. 4A, 4B and 5 are schematic diagrams of an exemplary electrical circuit in accordance with the devices of FIGS. 1-3.
Figure 4B:
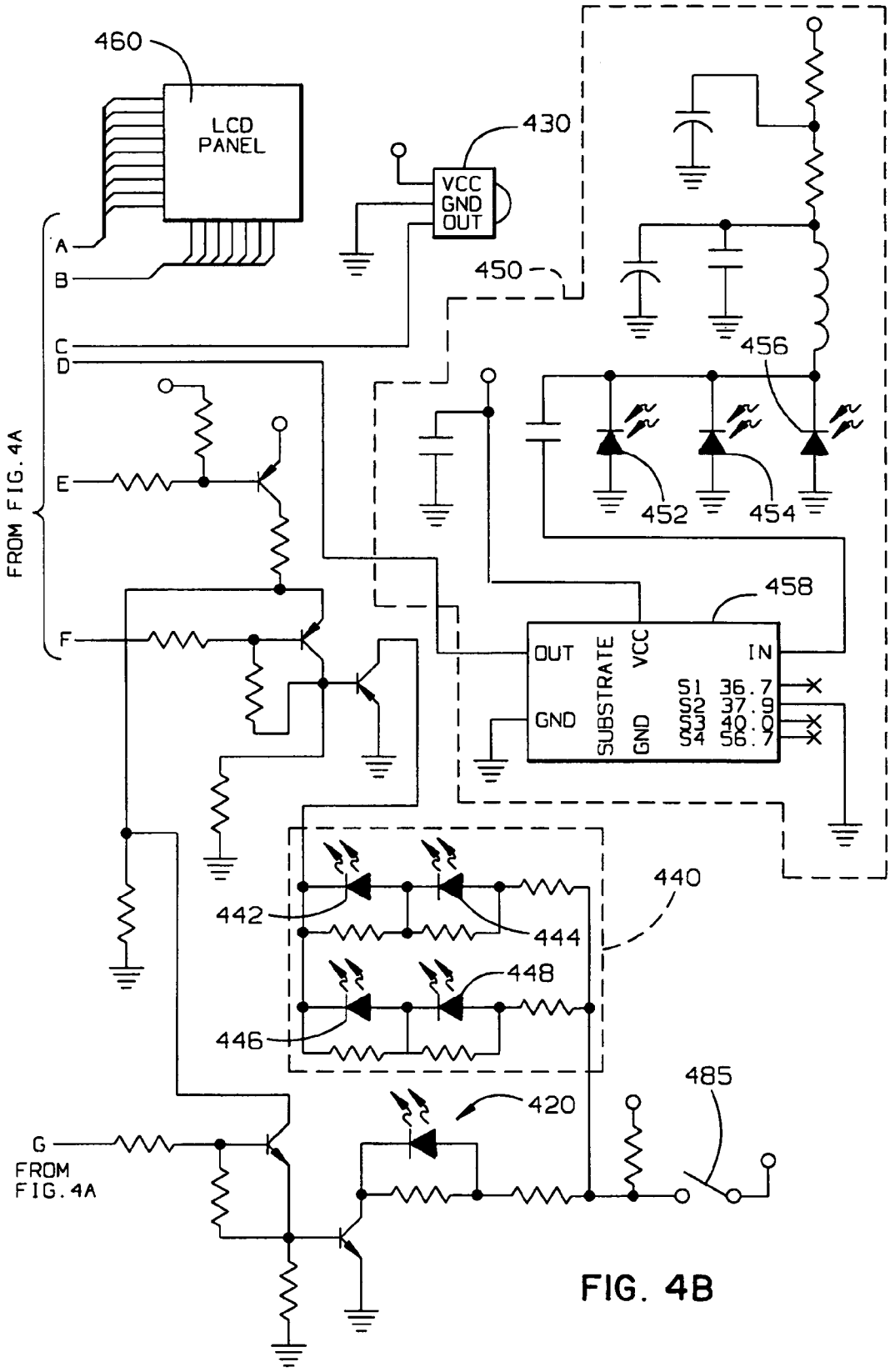
Figure 5:
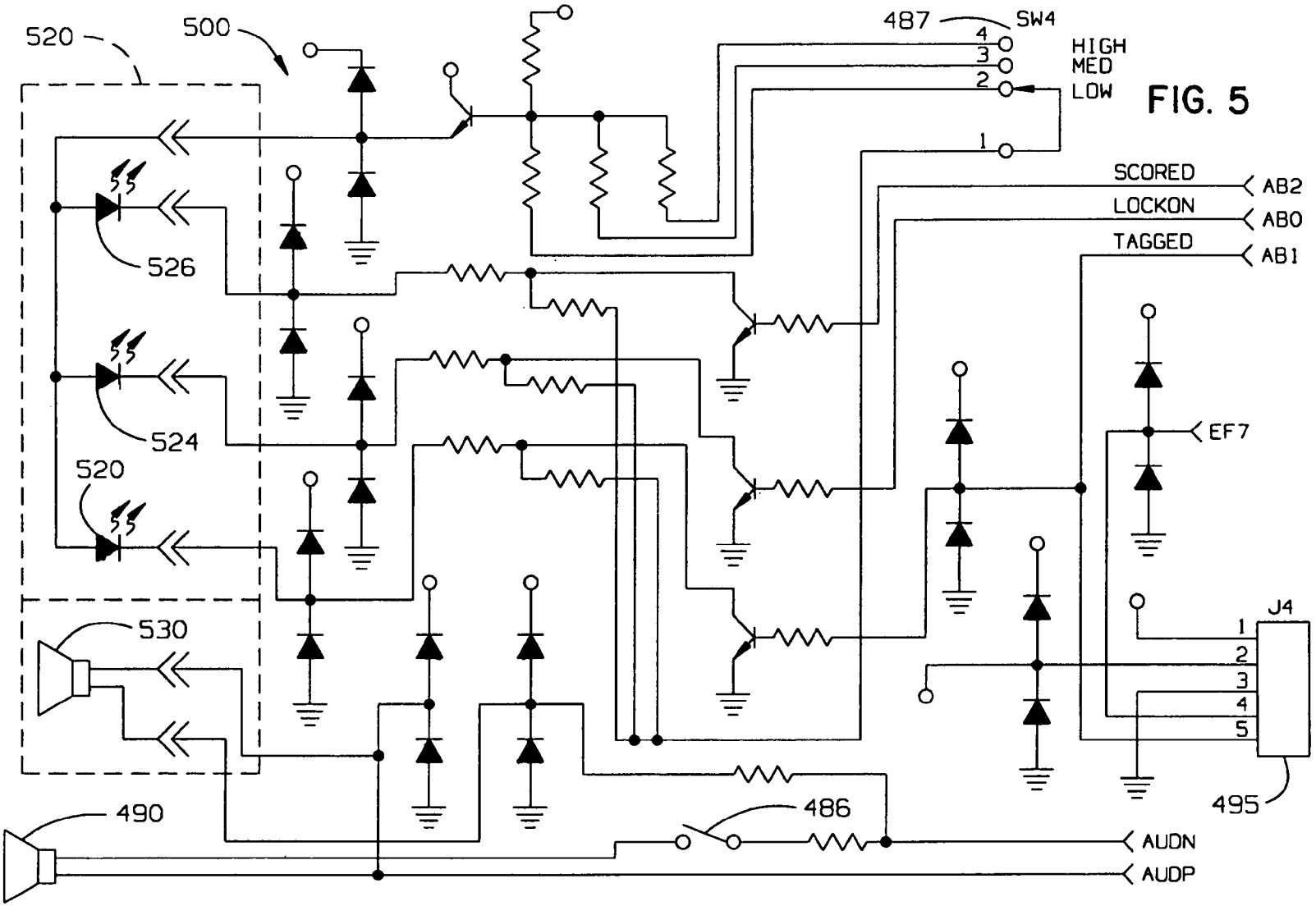

Referring now to FIGS. 4A, 4B and 5 an exemplary electrical system 400 is shown in accordance with the foregoing described exemplary playset including the device 10 and HMD 80. As shown in FIGS. 4A-B, the electrical system 400 includes a controller 410. The controller 410 may be any type of logic device known in the art such as a micro-controller, microprocessor, digital signal processor (DSP), programmable logic controller (PLC) or the like, that is operable to receive one or more inputs and affect one or more outputs relative to the received inputs. As shown, the controller 410 may be a single chip microprocessor containing RAM, ROM, input outputs (I/Os), and the like known in the art. One exemplary controller 410 is the SPL61A available from the Sun-Plus Technology Company, LTD. The SPL61A is an 8-bit CMOS single chip microprocessor including: 496 bytes of SRAM; 80 Kbytes of ROM; I/Os; an 8-bit resolution, 2-channel PWM audio output for direct driving of a speaker; and a display driver having 80 bytes of dedicated RAM for controlling a liquid crystal display (LCD). The controller 410 is powered by a power supply, which may include one or more power sources (e.g., batteries of different sizes and/or voltages).

As shown in the illustrated embodiment of FIGS. 4A, 4B and 5, the power supply includes two power sources BT1 412 and BT2 414 for energizing the various circuits and subsystems. In one exemplary embodiment each power source 412, 414 includes three AA-sized batteries to provide 4.5V and 9.0V total to the system 400. The system 400 may include fuses (F1, F2 FIGS. 4A-B) to protect the controller 410 and other system electronic components from power surges from sources 412, 414, due to faults or the like. As is known, the sources 412, 414 are disposed within the housing of a portion of the playset (e.g., within the barrel or grip portion of the gun), but the sources 412, 414 may be located externally, for example in an external battery pack that may be worn on the body or carried by the user. As shown, the sources 412, 414 cooperate with controller 410 and a switched power supply 416 to provide a switched voltage Vsw for energizing one or more of the foregoing subsystems, particularly receivers 430, 450 as shown in FIGS. 4A-B. Further, as shown, the system 400 includes crystal oscillator 418 and resistor oscillator 419, crystal oscillator 418 having a frequency of 32768 Hz for clock-type timing and resistor oscillator 419 generating 8 MHz master oscillation frequency within the processor 410. Although the oscillator 418 is external to and coupled with the controller 410 the oscillator may alternatively be integral with the controller 410.

As known in the art, the controller 410 operates under software control of software code, which may reside in the controller memory (e.g., ROM, RAM), to provide programmable and interactive device functionality and defined gameplay for two or more playsets that is described hereafter in further detail. To this end, the controller 410 receives user signals relative to user inputs from keypad 470 and buttons/switches 471-476 and 481-484 as well as remote signals received from other players/playsets via receivers 430 and 450. In response to receiving the user and remote signals the controller 410 outputs information to the user via display 460, speaker 490, HMD 480 and to other players/playsets via transmitters 420 and 440. As shown, the system 400 includes a first transmitter 420 linked with the controller 410 and a first receiver 430 linked with the controller 410, the first receiver 430 paired with the first transmitter 420 to provide a first transceiver for the system 400. The first transmitter 420 may be an infrared (IR) emitting diode or the like known in the art for outputting an IR or near-IR signal, and the first receiver 430 may be an infrared (IR) receiver or the like known in the art for sensing/detecting an IR or near-IR signal. Referring back to FIGS. 1-2, the first transmitter and receiver 420, 430 are disposed within respective tubes of the double-barrel portion of the gun-shaped housing to provide long-range, duplex (i.e., two-way) directional communications with another player, particularly a remote player up to several hundred feet away from the first transceiver, having a substantially similar playset.

Figure 6:
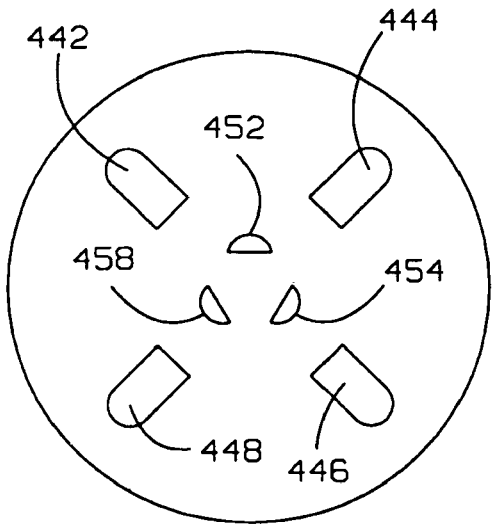
FIG. 6 is a plan view of an exemplary omnidirectional transceiver of the device of FIGS. 1-2.
Figure 7:
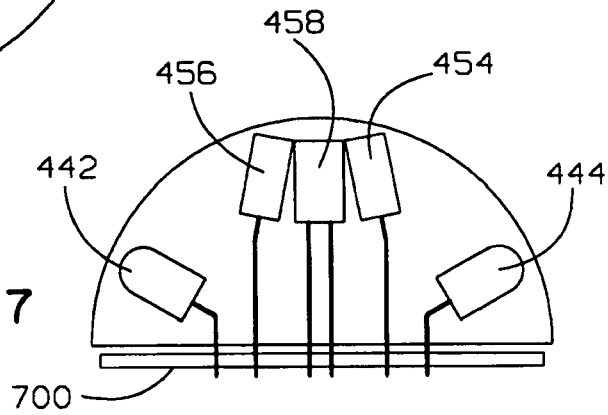
FIG. 7 is an elevation view of the exemplary omnidirectional transceiver of FIG. 6.

Similarly, the system 400 includes a second transmitter 440 linked to the controller 410 and a second receiver 450 linked with the controller 410, the second receiver 450 paired with the second transmitter 440 to provide a second transceiver for the system 400. As shown, the second transmitter 440 includes four infrared (IR) emitting diodes 442, 444, 446, 448 or the like known in the art for outputting an IR or near-IR signal, but fewer or additional IR emitting diodes may be provided. Referring now to FIGS. 6-7, the IR emitting diodes 442, 444, 446, 448 of the second transmitter 440 are shown disposed within the hemispherical dome illustrated in FIGS. 1-2. As shown in FIG. 6, the four diodes 442, 444, 446, 448 are arcuately oriented and spaced apart equally by approximately ninety degrees with respect to the center of the dome's base. Additionally as shown in FIG. 7, the diodes 442, 444, 446, 448 are inclined by about fifteen degrees above the base of the dome to provide an omnidirectional IR short range signal. An exemplary IR diode for this arrangement would be a diode with a +/− forty five degree beam emission, but other IR diodes and corresponding physical orientations thereof may be substituted as appropriate. As will be described hereafter in further detail, a primary function of the second transmitter 440 is to provide for constant transmission of a user identification signature or "beacon" so that players may identify each other as friend or foe (IFF) and target each other without the use of line of sight visual or audible cues such as recognizing a player's clothing, face or voice. The second transmitter 440 provides other functionality as well including facilitating communications with other proximate user's playsets.

The second receiver 450 includes three infrared (IR) photo receptors 452, 454, 456 or the like known in the art for detecting/sensing an IR or near-IR signal, but fewer or additional IR photo receptors may be provided. As shown in FIGS. 6-7, the IR photodetectors 452, 454, 456 of the second receiver 450 are illustrated as disposed within the hemispherical dome of FIGS. 1-2 along with the foregoing diodes 442-448. The photodetectors 452-456 are shown to be inset and elevated with respect to the diodes 442-448, but other suitable orientations of the diodes 442-448 and photodetectors 452-456 are suitable so long as the diodes 442-448 and photodetectors 452-456 do not interfere with each other and provide for omnidirectional transmission and reception of signals As shown, the three detectors 452-456 are arcuately oriented and spaced apart equally by approximately one hundred twenty degrees with respect to the center of the dome's base, and are inclined by about fifteen degrees (FIG. 7) with respect to the central axis of the dome's base. As mentioned, the second receiver 450 provides an omnidirectional IR sensor. An exemplary IR photodetector for this arrangement would be a photodetector with a +/− sixty degree beam detection width. As will be described hereafter in further detail, the second receiver provides a constant receiver to primarily identify other proximate users having playsets and to receive long-range signals transmitted from the directional transmitter 420 of a remote user's playset.

As shown in FIG. 7, the diodes 442, 444, 446, 448 and receptors 452, 454, 456 may be coupled to a circuit board 700 disposed within the base of the dome In one exemplary embodiment, the circuit board 700 is a printed circuit board (PCB) including the second receiver module 458 (FIGS. 4A-B).

As previously mentioned, the playset provides a programmable and interactive user interface. To this end, the system 400 includes a user interface having a display 460 linked to the controller 410 and a keypad 470 linked to the controller 410 for sending communications thereto. As shown in FIGS. 4A-B, the display 460 is a liquid crystal display (LCD) panel that is known in the art, and in one exemplary embodiment the display is a 213 dot, hyper-twisted nematic (HTN) panel. Although the display 460 is a LCD, the display 460 may alternatively be a video display such as a thin film transistor (TFT), a CRT, plasma screen or other known visual output display device. As can be appreciated, the display 460 is coupled to the programmable LCD controller/driver portion of the controller 410. The display 460 may provide one or more of an alphanumeric display and one or more indicia or icons which may relate to the communication between users' playsets and the gameplay. The keypad 470 includes a plurality of buttons 471-477. As shown in FIG. 1, the keypad 470 and display 460 are located proximate each other on the housing and facing the user when pointing the barrel portion outward. Each of the buttons 471-477 are user-operable contact switches linked to the controller 410 for entering information into the playset by scrolling through and selecting options via a pre-programmed menu structure, which resides in the controller memory and is displayable on the display 460.

Each of buttons 471-476 may have one or more functions including a main function and a second function. Second function button 471 enables the second function of buttons 472-476 by holding the second function button 471 while pressing one of the buttons 472-476. Additionally in an exemplary embodiment, second function button 471 may mute or un-mute sound effects produced via one or more of the speakers 490, 530 shown in FIG. 5. By pressing the display button 472, the user may select the type of information displayed on display 460 before, during or after a game. By pressing second function button 471 and display button 472, the user may adjust the contrast of the display 460. Decrement and increment buttons 473, 474 allow the user to select the previous or next items in a list of menu options, or decrease or increase a user-selectable value by one unit. By pressing the second function button 471 in conjunction with one of the decrement and increment buttons 473, 474, the user may decrease or increase a user-selectable value by ten units. The OK button 475 confirms a user's selected option or value displayed on the display 460. As discussed hereafter in further detail with respect to the gameplay, by pressing the second function button 471 in conjunction with the OK button 475, the game host may start or end a hosted game immediately. The cancel button 476 cancels a user's selected option or value displayed on the display 460 and may back up the menu structure by a menu step. By pressing the second function button 471 in conjunction with the cancel button 476, the user may quit a game and turn the playset off. A user may press the reset button 477 to return the system 400 to its factory settings, such as if the playset were to malfunction or behave erratically. By pressing the reset switch 477, the controller 410 is momentarily reset by shorting the reset pin of the controller 410 to ground potential as shown in FIGS. 4A-B. As described, the user interface including display 460 and keypad 470 permits a user to configure or otherwise program the functionality of the playset and the gameplay relative to two or more playsets (including rules, teams and other game characteristics discussed hereafter).

As shown in FIGS. 4A, 4B and 5 the system 400 includes a plurality of buttons and switches linked to the controller 410 for operating the playset and for customizing the operation of the playset relative to the user. Herein the user interface includes selection screens to adjust one or more gameplay parameters selected from the group consisting of game type, game time, number of tags to transmit, number of tags received until out tagged out, number of shields or shielded time and number of teams. To this end, the system includes buttons 481-484 for operating the playset and switches 485-487 for adapting the playset to the preferences of the user. Trigger button 481 is a switch associated with a first finger-actuated, movable trigger on the gun housing for transmitting a long-range communication (or "tag" as known in the art) to another player via directional transmitter 420. Shield button 482 is a microswitch associated with a second finger-actuated, movable trigger on the gun housing for disabling the omnidirectional transceiver including transmitter 440 and receiver 450 such that the playset is rendered temporarily invisible to other game participants. When the shield button 482 is pressed the playset will not transmit its identifying (i.e., beacon) signal and also will not receive tags from other participants playsets for a predetermined amount of time. The pump/reload button 483 is associated with the reload lever forward of the first and second triggers and is actuatable by the user to reload the playset with a predetermined quantity of transmittable tags. The function button 484 enables additional functionality for the foregoing trigger buttons 481, 482. For example, the user may enable a "mega tag" feature, which is a multiple tag transmit signal that may be used to quickly tag out another game participant from the game, by pressing and holding the function button 484 while repeatedly pressing the trigger button 481. In a team game the user may enable a "medic mode", which is used in to give assistance to or receive assistance from other players on the same team, by pressing and holding the function button 484 while pressing the shield button 482. Medic mode can be used to assist a player who is in danger of being tagged out, or to build-up one of the team's players.

The playset may be used indoors or outdoors, and to this end the system 400 provides a user-selectable switch 485 to increase or decrease the transmit signal (i.e., tag) strength of the directional transmitter 420 and omni directional transmitter 440. When using the playset indoors, the switch 485 should be in the open state so that directional transmit signals do not reflect and/or scatter thereby accidentally tagging other game participants such as team members. When using the playset outdoors, the switch 485 should be in the closed state so that the directional transmit signals may overcome any ambient IR sources. As shown in FIG. 5, the system may include a speaker 490, which may be internal to the housing for providing sound effects and/or simulated speech. The controller 410 may include a memory of one or more prerecorded sounds and/or synthesized voice, and the controller 410 may be operative to drive a speaker directly or via an audio amplifier for speech or melody synthesis. The controller 410 includes eight-bit resolution, two-channel pulse width modulation (PWM) outputs to drive the speaker 490. A speaker switch 486 may be opened or closed as desired by the user to respectively disable or enable the speaker 490.

As mentioned previously, the playset may include a user-worn interface such as a head-mounted display (HMD) or heads-up display (HMD) adapted to be worn on the users head for providing the user with a graphical or iconic interface 520 proximate the user's eye, and facilitating gameplay. As known in the art, the HMD may be removably coupled to the gun by way of a cabled connector, such as connector 495 shown in FIG. 5. Moreover, the gun may include other connectors or ports for coupling other removable or interchangeable devices/accessories to the gun. In the illustrated embodiment, the user-worn interface system 500 is coupled to the gun electrical system 400 and includes an iconic interface 520 having three light emitting diodes (LEDs) 522, 524, 526. As will be described hereafter in further detail, the interface 520 is made of a generally transparent or translucent see-through material and disposed proximate the user's eye so that the user's field of vision is not affected. As such, the user is able to see the real world while targeting game participants and discriminate friends from foes, among other things. The LEDs 522-526 may illuminate indicia or icons that correspond to one or more icons displayed on the display 460 so that the user need not maintain intermittent or constant visual contact with the gun. Thus, in one exemplary use, the user may move the gun to direct the directional receiver 430 in a side-to-side sweeping motion to quickly identify opponents and teammates with the user-worn iconic display 520. Further, the iconic display 520 enables the user to target and tag other participants that may be outside of the user's line of sight, such as around a corner or other obstruction. As such, the player can get visual feedback that his gun is properly aimed without having to look through a typical mechanical aiming sight mounted on the gun. As shown, the systems 400, 500 provide a user-selectable multi-position switch 487 for increasing and decreasing the light output of the LEDs 522-526 that is, ultimately, visible in front of the user's eye. In addition, the user-worn interface may include a speaker 530 that furthers the iconic interface 520 by providing the user with auditory indicia or signals corresponding to the one or more visible indicia or icons. In this manner, the HMD operates to output visual and audible cues to the user relative to the user's surroundings. In an exemplary embodiment, the red, green and yellow LEDs 522, 524, 526 are associated with icons indicating respectively that the user has been tagged by another player, that the user is targeting another player and that the user has tagged another player. Further, the speaker 530 may output audible cues facilitating IFF (e.g., a friend sound and a foe sound) when the green LED 524 is illuminated.

Figure 8:
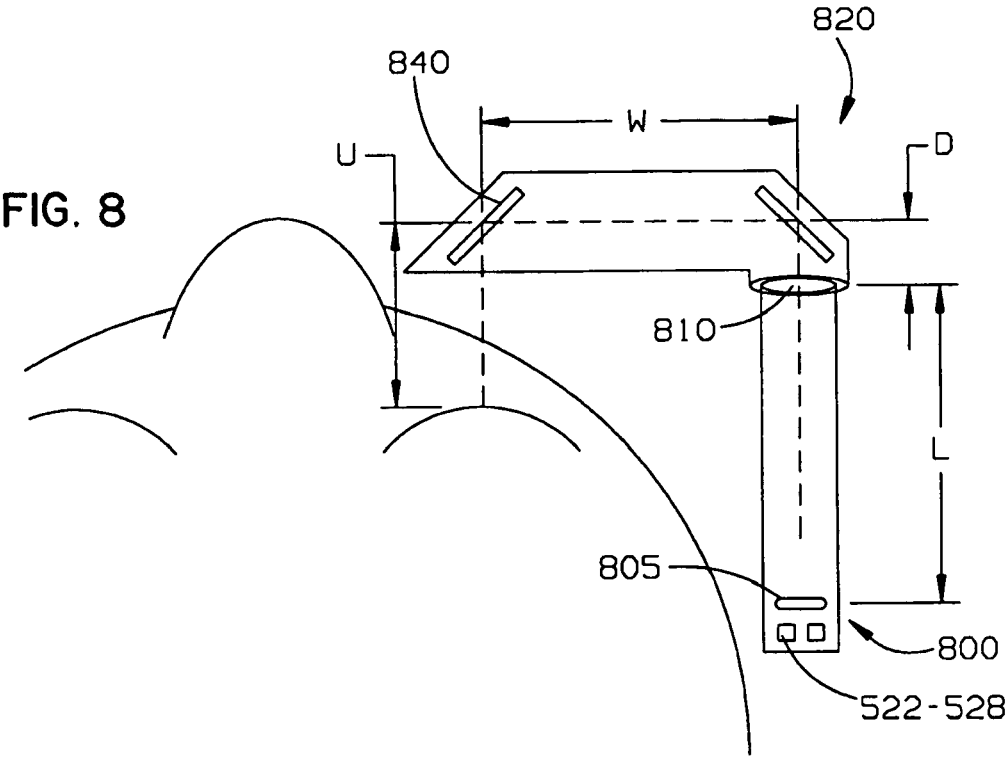
FIG. 8 is an exemplary optical schematic diagram in accordance with the display device of FIG. 3.

Referring now to FIG. 8, an optical schematic diagram illustrates operation of the HMD. As shown, the HMD is a folded-path optical system employing a first surface mirror and a partial mirror combiner. A backlit film is viewed through a head-mounted optical system including a fold mirror and a combiner (i.e., a partial mirror) in order to wrap the optical system around the side of the user's head. The HMD includes an optical projector 800 oriented along the side of the user's head and a see-through frame 820 coupled to the projector 800 and disposed in front of at least one of the user's eyes. The optical projector 800 includes a first end with the LEDs 522-526 and icon film 805, and a second end with a lens 810. The lens 810 is spaced apart from the film 805 by a distance L, which in an exemplary embodiment is approximately 73 mm, to magnify the illuminated icons on film 805 and transmit the icons to the frame 820. The first end of the frame 820 (proximate the lens 810) includes a first surface mirror 830 that is separated from the lens 810 by a distance D, which in an exemplary embodiment is approximately 13 mm. The first surface mirror 830 is oriented at an approximate forty five degree angle with respect the lens axis to reflect the illuminated icons along the width W of the frame 820 to the second end including combiner 840 that is spaced from the user's eye by a distance U. In an exemplary embodiment, the width W is approximately 60 mm and the combiner 840 is distanced from the user's eye by approximately 40 mm. The combiner 840 may be a partial mirror surface known in the art to allow the user a generally unobstructed view through the illustrated icons. In one exemplary embodiment, the displayed information comprising targeting of others, tags on the user by other and tags given to others, moves with the player's head as the HMD combiner 840 is mounted to stylized glasses. As such, the HMD and gun combination allows the user to enjoy game play information in his or her field of view while playing the game.

As is generally well known in the art, toy infrared gun and target systems work by transmitting a coded signal from the transmitter (gun) to the infrared receiver (target). This transmitted information is typically used to send a tag or hit signal to the receiver. If the target receives the appropriate coded infrared signal a tag is registered. Transmitters will normally focus infrared light into a narrow collimated beam using a lens in front of an infrared light emitting diode (LED). Receivers typically use a photodiode or photo detector to receive the coded infrared signal, however, receivers typically do not use any lens in front of the receiving device in order to have a very wide viewing angle. In such well-known infrared gun and target systems, only a one way path exists with the transmitter (gun) sending information to the target (receiver). In view of the foregoing description of the gun electronics, the subject toy gun system has multiple communication paths wherein the gun and the target both operate to transmit and receive coded information before (e.g., game setup/joining), during and after (e.g., gameplay analysis, player/team ranking) the game.

Assuming that there are two guns, (e.g., gun A and B) the communication paths for tags are as follows: the directional transmitter 420 of gun A transmits coded information that is received by omnidirectional receiver 450 of gun B. In order for gun B to receive the coded information from gun A, the barrel portion of gun A must be optically aligned with the omnidirectional receiver 450 of gun B. In a near-instant acknowledgment of receiving the coded information from gun A, the omnidirectional transmitter 440 of gun B outputs coded information that is received by the directional receiver 430 of gun A since the barrel portion of gun A has not moved substantially in the instant between gun B receiving the coded information from gun A and outputting the acknowledgement. As such, two way communication may be achieved between two or more guns. Since the transmit and receive functions of the omnidirectional transceiver are substantially 360 degrees about the users, the orientation or attitude of gun B is inconsequential to achieve communications. This two way optical path can be used for any closed loop communications. Two or more guns may also communicate directly through the omnidirectional transceivers, but the communication range is on the order of approximately 25 feet. The advantage of communication through the omnidirectional transceivers is that there is no need to optically align the guns. Thus, proximity warnings and gameplay features may be enabled as described hereafter.

The gun software uses four infra-red communications channels (two directional and two omnidirectional) to create a multinode network, such that each gun unit (and user) may be identified uniquely, assigned to a team as appropriate, and communicate with other users/game participants in the network as needed. The network of intermittently communicating gun units forms a game. Unit-to-unit communications may be performed either specifically or generically. In a specific communication either or both of the transmitting units addresses a specific other unit in the game so that any units receiving the transmission other than the intended receiver will know that they should ignore the communication. In a generic communication, the transmitting unit broadcasts information using either or both of the transmit channels, and such information is accepted and processed by all other units that receive the broadcast data. Such communication options enable two or more gun unit users to enjoy gameplay and device features significantly advanced beyond the traditional game of laser tag. For example, the subject system allows a host gun unit to wirelessly program, through IR transmission, one or more other gun units with the same game definition having selected gameplay characteristics. Thus, the host operates to facilitate team games and other advanced and customizable gameplays.

To this end, the host user selects the type of game to play and adjusts the game characteristics using an interactive menu-driven interface. This provides a much more intuitive method to select a game and adjust the game particulars than the cumbersome and complex method of combinations of key press codes as generally known in the art. The host unit is programmed with the game definition by one user, and then the host unit automatically broadcasts/transmits the game definition to all other units wishing to join the game. This joining process eliminates or substantially reduces errors and misunderstandings that might otherwise lead to different players not playing the same type of game. It also simplifies the method of joining a game, so that less experienced players can still participate in complex games without having to go through a complex process of learning how to play/participate.

A multi-player game may begin with an optional "host/join" process, wherein one unit that is designated as the host is programmed with the game definition by one user. Subsequently, the host identifies itself and broadcasts the parameters of the game (e.g., gameplay, rules, etc.) that is about to be played to all other units in an area proximate the host. These other units, known hereafter as the joiners, receive the game definition and may elect to participate by communicating with the host. Each joiner receives the game definition and a unique identification (ID) code. Further, if the game is played in groups of two or more teams the host associates each of the joiner's ID codes with a team ID code, which will later facilitate team ranking and other gameplay analysis. The foregoing pre-game host/joiner communication are performed via the omnidirectional transceivers of the gun units.

After all units that will participate in the game have been joined by the host, the game may start after a delay during which the users take up their initial positions for the game. This initial game delay is identified by a count-down to zero (called the "t-minus countdown"). If the host/join process was used, this countdown is broadcast by the host to all of the joiners so as to synchronize the starting time of the game for all participants. In this manner, all participants in the game will start and end their games together. Further, the host may broadcast information identifying the IDs for all valid units in the game to allow all units to more easily reject spurious communications (e.g., tags received from non-joining units or units joined to another adjacent game). Once the t-minus countdown is completed the active phase of the game begins.

During the active phase of the game, the omnidirectional transmitter is used primarily to send "Beacon Signatures" identifying the transmitting unit. As previously mentioned, such a broadcast beacon signature signal allows the units in the game to "lock-on" to or otherwise target and identify other player's units as friend, foe or neutral (IFF). Further, the omnidirectional transmitter operates to transmit an acknowledgment signal confirming the receipt of any tags by the unit's omnidirectional receiver. As a secondary function, this omnidirectional infrared channel may be used to transfer data, such as broadcast text messages and the like between players in a game (e.g., medic-mode transfers) or between special-role units (e.g., bases, zones, etc) and units in the game. During the active phase of the game, the directional transmitter is used primarily to send "tag signatures" or tags in response to the user's trigger actuation. As is known, players attempt to "land" these tags on the other players in order to score points, tag-out opponents and win the game. However, this channel may also be used to send directed or specific communications for the purposes of text messaging, programming accessories, etc.

Throughout the game each unit records all meaningful occurrences of the various signatures being transmitted, received, time elapsed before the player is tagged-out, and such other interactions as may be relevant to the final analysis of each unit's gameplay including scoring of the game and player/team ranking among other things. Once the game has ended either by timing out of the game duration or alternatively if the host manually ends the game, if the host/join process was used to start the game then the host will begin a "debriefing" process whereby it interrogates each individual joiner that was in the game. Each joiner upon interrogation by the host reports its collected game performance by transmitting stored data relative to that unit's gameplay back to the host. Once the host has aggregated all of the available joiner's gameplay data, it combines and analyzes the data in order to rank each of the individual players and teams within the game. The host then transmits the rankings back to the joiners for their review. In addition, players can individually call up head-to-head scoring information to determine how they did specifically against each of the other players in the game. If one or more of the joiners does not respond to the hosts interrogation, such as, for example, if a joiner had to leave the game before the end for some reason or if the joiner malfunctioned, the host operates to discard or otherwise reconcile any data received from the responsive joiners relative to the non-responsive joiners.

Data exchanged over the various communications channels can be categorized as four basic types: (1) beacon signatures, (2) area signatures, (3) tag signatures and (4) packet data. The device will transmit and receive a series of encoded infrared light signals which form a predetermined signature including an active synchronization pulse of duration X or 2× and an inactive pause of duration Y. The first active data pulse has a "0" state defined by an active pulse of less than half the duration of the duration X synchronization pulse or less than a quarter duration of the duration 2× synchronization pulse. The second active data pulse has a "1" state defined by an active pulse of more than half the time duration of the duration X synchronization pulse or more than a quarter the duration of the duration 2× synchronization pulse. The last inactive pause the follows a series of the first or second active data pulses, with the last inactive pause being longer than duration Y. The active synchronization pulse of duration X or 2× is either 3 ms+/−20% or 6 ms+/−20% respectively and the inactive pause of duration Y is 2 ms+/−20%. The series of the first or second active data pulses followed by the last inactive pause numbers no less than 5 and no greater than 9 active data pulses with the last inactive pause being longer than 20 ms. The signature is preceded by a pre-synchronization pulse with an active period of 3 ms+/−20% followed by pause of 6 ms+/20%. The beacon signatures include a 6 ms+/−20% synchronization pulse, and the tag signatures and packet signatures include a 3 ms+/−20% synchronization pulse.

Beacon signatures are broadcast regularly and automatically during the game by each unit for identifying information about the status of the sending unit (i.e. team affiliation, player ID, whether or not the sender has just been tagged, etc.). When the beacon signature is received by the directional receiver of another unit, the beacon signature may facilitate a targeting or "locked-on" condition in the receiving unit. When received by the omnidirectional receiver of another unit, the beacon signature may facilitate a "proximity warning" condition in the receiving unit.

Area signatures are a modified form of the foregoing beacon signatures. Area signatures are always broadcast on the omnidirectional transmit channel, and are used to identify a physical area of special significance within a game, for example, a base, an area being contested, a neutral "safety" area, or such other area as may be defined in the game. When an area signature is received by the directional receiver of another unit, the area signature may facilitate a targeting or "locked-on" condition in the receiving unit (if the area signature signifies a base associated with a team in a game), or may simply be ignored. When received by the omnidirectional receiver of another unit, the area signature facilitates a "special zone" condition in the receiving unit. The software of the receiving unit then uses this special zone condition to enable special processing functions associated with the specific area, such as, for example recording the cumulative time spent in the area, re-enabling a disabled unit, etc.

Tag signatures are typically transmitted on the directional transmit channel and identify the ID of the sending unit and may also include additional information. For example, a unit may transmit a "mega tag" such that the tag signature includes information that identifies "extra tag points" the user has added to this signature to cause any receiving unit to act as if multiple copies of the single tag signature had been received in rapid succession. When the tag signature is received on the directional receive channel of another unit, these signatures are generally ignored. When the tag signature is received on the omnidirectional channel of another unit, the tag signatures result in the receiving unit processing the signature as one or more "tags" or hits being received from the sending unit, which is recorded for analysis by the host.

Packet data signatures are typically transmitted and received on the omnidirectional infrared channels, and are used to transfer more extensive information than can be represented using the foregoing signatures. Such packet data can be game definitions, player-to-player communications, text messages, or other communications known in the art. Packet data signatures may be transmitted and received using any combination of the directional and omni directional transceivers. For instance Text Messaging is transmitted from the directional transmitter of the initiating unit and received on the omni directional receiver of the receiving unit.

Exemplary Communications Details

Figure 9A:
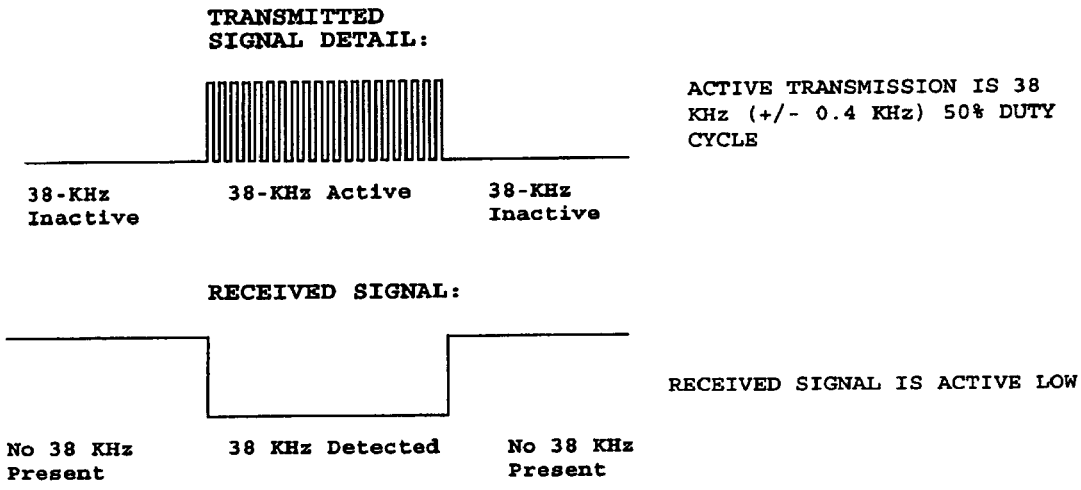
FIGS. 9*a*-9*g* illustrate exemplary infrared signal waveforms facilitating infrared shooting game communications between two or more game devices.

All infrared communications consist of a 38 KHz carrier frequency modulated on or off by the data to be transmitted, the resulting signal driving an infrared light emitting diode (IRLED) creating a signal of modulated 38 KHz IR, which when detected by the receivers results in an active-low signal as shown in FIG. 9*a*. Periods of active 38 KHz modulated IR generation are called "bursts" while the resulting active-low outputs of the receivers are referred to as "pulses." The periods when no 38 KHz modulated IR is present and the resulting output of the receiver is high are both called "pauses".

Because the integrated circuit receivers used to detect the IR signals may have a problem initially identifying a signal and isolating it from any background or ambient level of IR energy, each signature is preceded by a "Pre-Sync" burst of modulated energy followed by a "Pre-Sync Pause" to allow the receiver to set its gain levels to match the signal that follows. This forms a "throw-away" pulse at the start of each signature which will not affect anything if its duration is distorted as the receiver circuitry tries to properly acquire the incoming signal.

Because the controllers of different units can typically be expected to be running at different speeds from one another, particularly if a lower-cost resistor oscillator or R/C oscillator is used for timing, the Pre-Sync Pause is then followed by a Sync pulse of a known duration as perceived by the transmitting unit. This allows the receiving unit to identify what speed the transmitting unit's controller is running at relative to the receiver's controller speed so that variations in timing can be properly accounted for. The Pre-Sync and Pre-Sync Pause help to ensure that the duration of this pulse is exactly as intended by the transmitting unit.

Figure 9B:
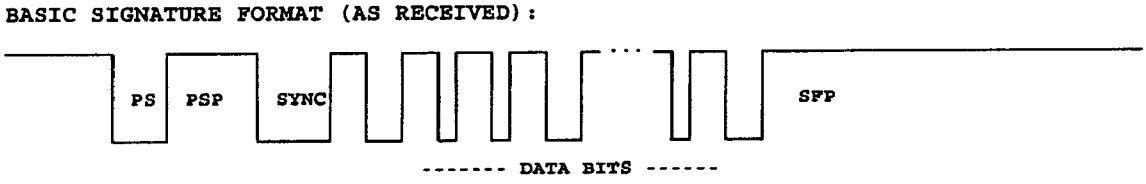

As a result of the foregoing, all signatures consist of a Pre-Sync (PS), a Pre-Sync Pause (PSP), Sync, and a plurality of data bits, as shown in FIG. 9*b*. As shown, a "Special Format Pause" (SFP) is added at the end of each signature, to accommodate those receivers which require that the modulated IR signal be entirely gone for a period of time (typically 20 msec out of every 100 msec) in order to allow the receiver to identify background levels of 38-khz noise and reject it.

Figure 9C:
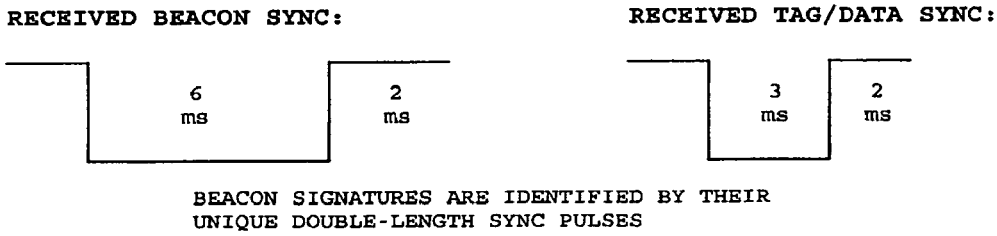
Figure 9D:
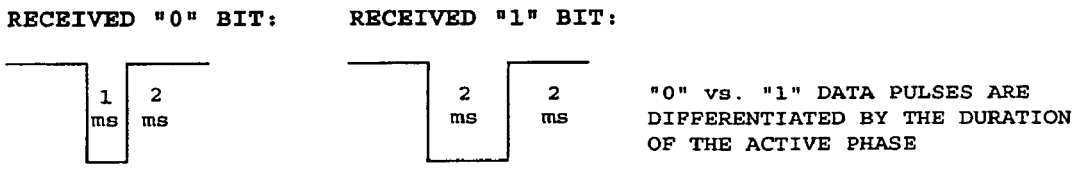

During a game, all units attempt to cooperate such that data "collisions" will be kept to a minimum. However, it is a fairly common occurrence for the signatures from two or more different units (which typically cannot see each other's signatures) to arrive simultaneously at the omnidirectional receiver of a common target unit, causing a corrupted signature to be received by that target unit. During normal game play, such corruption is most frequently seen as the beacon signatures from the other units colliding at the receiver of the common target unit, resulting in a signature which looks very much like a valid tag signature. To prevent the receiving unit from interpreting such a corrupted signature as a spurious tag signature, all beacon signatures (including area signatures) use a longer Sync Burst than do the tag or packet data signatures as shown in FIG. 9*c*. In this way, the receiving unit can know that the signature it began receiving was a beacon or area signature. Thus, if the received signal simulates a tag signature (FIG. 9*c*), the receiving unit may discriminate the received signal as spurious data. As shown in FIG. 9*d*, aside from the PS and Sync bursts, all data bits are either a "0" (e.g., a short burst with a duration of 1 msec) or a "1" (e.g., a long burst with a duration of 2 msec). All data bits are followed by a 2-msec pause to separate bits from one another.

Figure 9E:
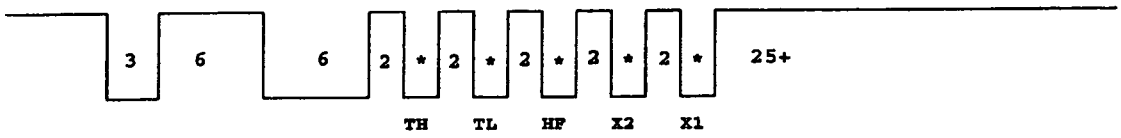

As shown in FIG. 9*e*, beacon signatures include the PS and Sync pulses followed by five bits of information about the sending unit. The five bits are as follows:

- TH and TL bits identify the team affiliation (if any) of the transmitting unit. These bits do not necessarily represent a "team" in the normal sense of the word (although they can) and may facilitate a means for the system to keep track of more than a predetermined number (e.g., 8) players in a game.
- HF is a Hit Flag which, when set, indicates that this signature was generated in response to the transmitting unit taking one or more tags—if not set, it was sent automatically based on the internal timer of the transmitting unit ordering regularly-timed beacons.
- X2 and X1 bits are Extended information, and are used to represent how many extra tag points were in the tag just received (if HF is 0, these will both be 0 as well).

Area signatures are special cases of the beacon signature in which HF is 0 but X2 and X1 contain at least one "1" bit. These combinations would make no sense as a beacon signature from a player unit, and are thus reserved for the various different area signatures. The area signatures are defined in Table 1.

TABLE 1

| X2 | X1 | Area signature definition |
|---|---|---|
| 0 | 1 | (reserved for future use) |
| 1 | 0 | area being contested in game |
| 1 | 1 | team base (base may be designated as a neutral territory) |

Figure 9F:
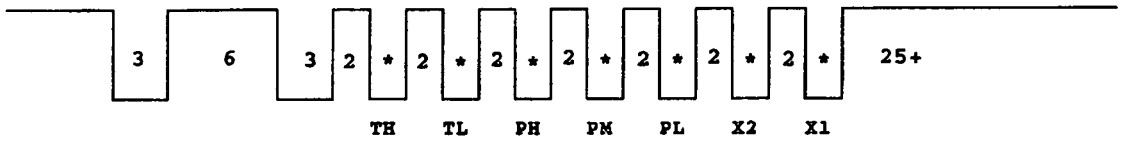

As shown in FIG. 9*f*, tag signatures include the Pre-Sync, Pre-Sync Pause, Sync, and 7 data bits. Tag signatures contain the unique ID of the transmitting unit, and extended data indicating the number of extra tag points (if any) added by the user to this tag (e.g., mega tag). For extended data definitions, see Table 2. Bits TH, TL, PH, PM, and PL form the unique ID assigned to each playing unit in a game. Alternatively, for games that were not hosted/joined, such as traditional laser tag, all players share a single ID which is all 0s in these bits. As shown, this data essentially represents a two-bit team identifier and a 3-bit Player identifier, but as mentioned previously the "team" should not be construed to be necessarily a team in the normal sense of the word and it may facilitate a means for the software to keep track of more than a predetermined number of players at a time.

TABLE 2

| X2 | X1 | extended data definition |
|---|---|---|
| 0 | 0 | no mega, counts as 1 tag |
| 0 | 1 | 1 mega, counts as 2 tags |
| 1 | 0 | 2 megas, counts as 3 tags |
| 1 | 1 | 3 megas, counts as 4 tags |

Because each player in a hosted/joined game has a unique ID, all tags taken by every player in a game can be recorded by the unit receiving the tags for analysis, reporting and comparison after the game has ended. This allows each player to know not only how many times he or she was tagged by other players or tagged other players, but the player can also determine exactly who those other players were and how many times he or she tagged or was tagged by each of them.

The following packet data communications may be used for communicating more complex information than the specific information involved in the beacon, area, and tag signatures. Such complex data may be exchanged between two or more units at the beginning of a game to allow a host to automatically program joiners with the details of the game about to be played, to synchronize all players in a game and ensure that they all recognize or know the IDs that will and will not be valid during the game. During a game, such complex data may be exchanged between two or more units to allow players within the game to communicate and even transfer resources or liabilities to one another. After a game, such complex data may be exchanged between two or more units to allow performance data collection, ranking, and comparison of all units, among other things.

Figure 9G:
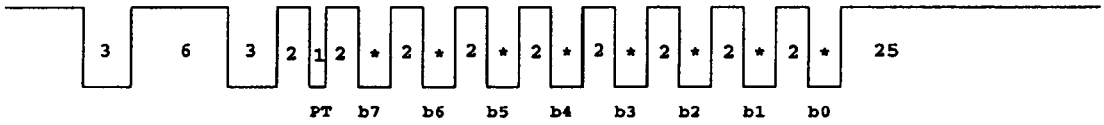
Figure 9G:
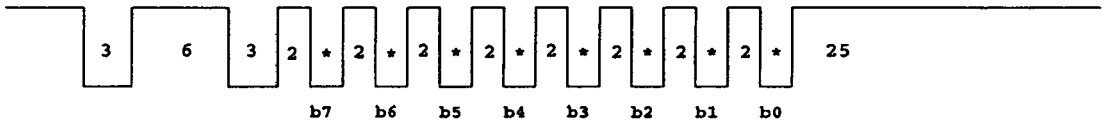
Figure 9G:
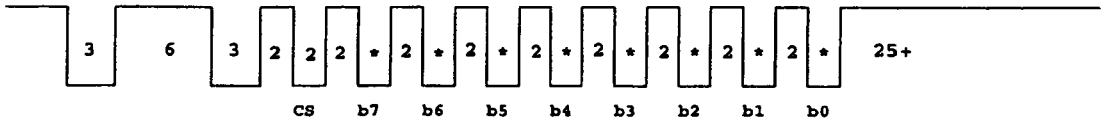

Packet data signatures can be any one of three basic types, depending on where they occur in the data stream. The first signature in the data stream (containing the first byte of information) is always a packet type byte, or "Ptype" as shown in FIG. 9*g*. There may or may not be one or more data bytes following the Ptype. All data streams are then terminated with a Checksum Byte, or "Csum." In addition to the expected Pre-Sync, Pre-Sync Pause, and Sync bytes, the packet data signatures will have either 8 (for data bytes) or 9 (for Ptypes and Csums) data bits. The first data bit in the Ptype and Csum signatures identifies which type of communication it is—0 for Ptype, or 1 for Csum. As shown, b7 . . . b0 are the data bits (b7=MSb, B0=LSb). The numeric values (b7 . . . b0) of the Ptype byte plus all subsequent data bytes are added in an 8-bit register as each byte is received, and this 8-bit value is compared against the value (b7 . . . b0) of the Csum byte when it is received. Any data stream which did not begin with a Ptype or did not end with the correct Csum will be rejected and thus ignored.

There is no specific data-length byte in the packets, as each Ptype tells the receiving unit what the meanings of the data bytes to follow are. Some packets are variable-length and thus do contain a data-length byte of one format or another, but this is not required in packets which are not variable-length. The maximum length of any packet is 22 bytes, including the Ptype and Csum.

Exemplary Game-Programming Communications

As previously mentioned, games are selected and defined through the use of a menu-driven process in which the user inputs data to the system software through the various input buttons, and the software displays prompts and selected values on the displays. In addition to pre-defined games which the user may not modify, the system also allows the user to select games which the user may then customize to his/her own liking. Once the game has been fully defined (either by default or by user modification), this definition is automatically passed from the host to all joiners in the area.

An example of the information transmitted from the Host to the Joiners in order to define the game is as follows:

| Order | Type of byte | Value | Meaning |
|---|---|---|---|
| 1 | Ptype | $0C | Special Game Definition |
| 2 | Data | $2C | Host's I.D. code (randomly chosen for each game) |
| 3 | Data | $15 | Game will last 15 minutes |
| 4 | Data | $50 | Each player is "out" after taking 50 tags |
| 5 | Data | $FF | Each player has an unlimited number of reloads |
| 6 | Data | $45 | Each player has 45 seconds of shields time |
| 7 | Data | $12 | Each player has 12 Megas |
| 8 | Data | $28 | Packed Flags Byte #1 = 00101000 |
| 9 | Data | $A2 | Packed Flags Byte #2 = 10100010 |
| 10 | Data | $32 | ASCII Character "2" |
| 11 | Data | $5A | ASCII Character "Z" |
| 12 | Data | $4F | ASCII Character "O" |
| 13 | Data | $4E | ASCII Character "N" |
| 14 | Csum | $E6 | (8-bit total of all preceding bytes) |

The foregoing packet defines a special game which will be hosted by a unit calling itself "2C". The game will last for 15 minutes, and in this game each player will have 50 tags until tagged out, unlimited reloads, 45 seconds of shield time, and 12 mega tags available. The game will be called 2ZON (short for "2 Zones"), and the details of how it will be played are defined by the two Packed Flags bytes that include:

| | |
|---|---|
| $28: | 00101000 |
| DX = 0: | Extended Tagging not required to disable players |
| AL = 0: | Ammunition (Reloads) is not limited |
| ML = 1: | Mega tags are limited |
| FF = 0: | Friendly Fire does not affect teammates |
| MM = 1: | Medic Mode is allowed |
| TT = 0: | Rapid Tags are not ignored |
| HH = 0: | Teams are not divided into Hunters and Hunteds |
| SD = 0: | Hunters-Hunteds Starting Direction is irrelevant |
| $A2: | 10100010 |
| ZG = 1: | There are Zones of contention in this game |

-continued

| | |
|---|---|
| BT = 0: | Bases are not associated with teams |
| TD = 1: | Tagged players are temporarily disabled |
| BU = 0: | Base areas do not un-disable tagged players |
| BH = 0: | Base areas are not Hospitals |
| BF = 0: | Base areas do not Fire at players |
| NT = 10: | Number of Teams in the game is 2 |

An example of data being transmitted during a text message sequence

| Order | Type of byte | Value | Meaning |
|---|---|---|---|
| 1 | Ptype | $80 | Text Message |
| 2 | Data | $48 | H |
| 3 | Data | $45 | E |
| 4 | Data | $4C | L |
| 5 | Data | $4C | L |
| 6 | Data | $4F | O |
| 14 | Csum | $F4 | (8-bit total of all preceding bytes) |

The forgoing packet defines a Text Message transmission during gameplay. The receiving unit will display "HELLO" in the alpha numeric LCD display of the receiving unit.

As can be appreciated, the software may allow for additional Packed Flag Bytes to be sent to tell joiner units how to process other situations beyond those already covered in the foregoing description and example. Units encountering situations for which no Packed Flag Bytes are sent will simply ignore the situation and not allow it to affect gameplay. If the game definition broadcast by the host involves dividing the various joining players into functional teams, the joining players may then select a preferred team to associate with. Alternatively, if the joiner has no team preference or the joiner's preferred team is full, the host may assign the joiner to a particular team. After any needed team preference has been supplied, the joiner unit automatically communicates with the host to receive an assigned player ID.

Once the host has determined that all units have been joined into the game (either because no new unit has requested an ID, because the host user has told the host unit that all other units have been joined or because there is no room left in the game for any more units to join), the host initiates a thirty second t-minus countdown and broadcasts the T-minus value along with a set of bytes identifying all units that were successfully joined to the game. When the joiner units receive this broadcast information they will then know when to start the actual game (based on the t-minus countdown value), which signatures are and are not valid in this game (based on the Packet Flag bytes and the list of valid IDs sent with the t-minus value) and how long to play the game (based on the information received in the game definition).

During the T-Minus countdown, an additional feature called "Cloning" may be allowed. In the Cloning process, two units being operated by a single player agree to share a single Player ID and some of the resources and liabilities assigned to the player by the Host. While the first of these two units, called the "Master," Joins or Hosts the game in the normal fashion, a second unit called the "Slave" listens for the game particulars as transmitted by the host but does not request nor receive a unique Player ID. Instead, once the T-Minus countdown has begun, it is "programmed" by the Master with the Player ID it will use during the game. This process is accomplished by sending and receiving Tag signatures using the directional transceivers during the T-minus countdown period, a time during which tag signatures would otherwise be meaningless as the game has not actually started yet. The Master sends a plurality of basic Tag Signatures which are received by the Slave, and the Slave responds by echoing a plurality of the same Tag Signature but with a different pattern of "extended Information" bits (1 extra tag point). If the Master receives the correct response, it considers the Cloning to have been successful and responds with a single tag signature of the same ID but having yet different "extended information" bits (2 extra tag points), and the Slave upon receiving this signature will consider the Cloning to have been successful. But if the Master does not receive the correct response, it sends a plurality of significantly different Tag Signatures to indicate that the process has failed and must be attempted again. Once the Master and Slave have determined that the Cloning process has been a success, they each divide the number-of-tags-until-out and the number of reloads available per player between themselves (the Master receiving the larger share if it cannot be evenly divided), and the two units will play through the programmed duration of the game with the same basic game definition and Player ID. Once the game has concluded, the Master may collect such data from the Slave as is needed for reporting back to the Host, allowing the Host to properly score a game in which the single player has used multiple game units to achieve his score.

Once the t-minus countdown reaches t-minus-zero (T-00) the game begins automatically and runs for the predetermined game duration or until the host declares an early end to the game (by beginning the debriefing/interrogation process early). During the game all signature interactions that are important to the game, such as tag signatures received, Zone area signatures received and the like are recorded by each unit so that the host unit may compare each player's and each team's gameplay after completion of the game. A player may be "tagged-out" before the game ends in which case his/her unit remains disabled until the end of the game and is then debriefed by the host just as if he/she had not been tagged-out.

When the game ends, the host then interrogates/queries all joiner units initially joined to the game for their recorded data. Each unit being interrogated then reports the requested gameplay data for that unit back to the host. The host combines all of the data received from each joiner unit, processes or otherwise analyzes the data and compares the results for each player (and also for the various teams, if applicable) in the game. The host then, based on the scoring parameters for the game, ranks all of the players and teams. Any joiner unit that is not debriefed by or otherwise does not communicate with the host after the game is treated as a unit that never joined the game. The compiled scores are ranked, and the resulting ranks are transmitted by the host to all joiners. Each player in the game can thus know one or more of the following: how well he or she performed individually (based on the objectives of the game), how well his or her team performed as a team (again based on the objectives of the game) and how well he or she performed individually versus each of the other individuals in the game (based on tags transmitted to the other players versus tags received from other players).

Exemplary Gameplay

CLASSIC LAZER TAG (LTAG)—The object of this game is to be the last player not tagged out. In the Classic LAZER TAG game, all other players are your opponents.

Preset game features include:

No Hosting, game starts immediately at T-10

No Teams or Player ID's

Any number of players may play 15 seconds of Shield time allowed

Unlimited Reloads

12 Mega-Tags

Players are tagged out after taking 10 Tags

No score ranking—last player NOT tagged out wins.

After being tagged out, a player's elapsed time in the game (from the start of the game to the time at which the player is tagged out) is displayed on the player's screen.

CUSTOM LAZER TAG (CUST)—The object of this game is to be the last player not tagged out, while scoring as many tags against your opponents as possible. In the Custom LAZER TAG game, all other players are your opponents. This variation of Classic LAZER TAG allows all game options to be programmable.

Game features include:

Fully hosted, (requires hosting/joining) and supports post-game debriefing 2-24 players may be in the game, players have individual ID's No Teams, All players are opponents of each other Time—1-99 minutes, (default=10 min)

Reloads—0-99 or Unlimited (default=Unlimited)

Mega-Tags—0-99 or Unlimited (default=10)

Shields—0-99 seconds (default=15)

Tags—1-99 (default=10)

Ranking is individual only

2-TEAM CUSTOMIZED LAZER TAG (2TMS) and 3-TEAM CUSTOMIZED LAZER TAG (3TMS)—The object of these games is to have the most number of your team's players remain in the game while scoring as many tags as possible on opposing players. In these games, some of the other players are on the same team as you, while others are on one or two opposing teams.

Game features of the foregoing team customized games include:

Fully hosted, (requires hosting/joining) and supports post-game debriefing 2 or 3 teams of up to 8 players per team Team Tags (selectable)—Yes (Y) or No (N) (default=Y)

Medic Mode (selectable)—Yes (Y) or No (N) (default=Y)

Time—1-99 minutes, (default=15 min)

Reloads—0-99 or Unlimited (default=Unlimited)

Mega-Tags—0-99 or Unlimited (default=10)

Shields—0-99 seconds (default=15)

Tags—1-99 (default=20)

Ranking is individual and team

HIDE AND SEEK (HDSK)—The object of this game is to score as many tags as possible on the other team while seeking them, and avoid taking tags while hiding from them. Players are divided into two teams. At any given time, one team is seeking while the other team is hiding. The teams switch between seeking and hiding every 60 seconds.

Game features include:

Fully hosted, (requires hosting/joining) and supports post-game debriefing 2 teams of up to 8 players per team Team Tags (selectable)—Yes (Y) or No (N) (default=Y)

Medic Mode (selectable)—Yes (Y) or No (N) (default=Y)

Time—2-98 minutes (minutes in multiples of 2), (default=10 min)

Reloads—0-99 or Unlimited (default=5)

Mega-Tags—0-99 or Unlimited (default=15)

Shields—0-99 seconds (default=30)

Tags—1-99 (default=25)

Ranking is individual and team:

HUNT THE PREY (HUNT)—The object of this game is to score as many tags as possible on the other team while seeking them, and avoid taking as many tags as possible while hiding from them. This game is like Hide and Seek, but with the added complexity that players are divided into three teams. At any given time, your team will be hunting one team while hiding from the other team. Every 60 seconds the hunting direction switches so that you must now hide from the team you were just hunting and hunt the team you were just hiding from.

Game features include:

Fully hosted (requires hosting/joining) and supports post-game debriefing

3 Teams. Up to 8 players on each team

Team Tags (selectable)—Yes (Y) or No (N) (default=Y)

Medic Mode (selectable)—Yes (Y) or No (N) (default=Y)

Time—2-98 minutes (minutes in multiples of 2) (default=10 min)

Reloads—0-99 or Unlimited (default=5)

Mega-Tags—0-99 or Unlimited (default=15)

Shields—0-99 seconds (default=30)

Tags—1-99 (default=25)

Ranking is individual and team:

2-KINGS (2KNG) and 3-KINGS (3KNG)—The object of these games is to tag out the opposing team's King while protecting your own king. The Kings on any of the teams are not known to the other teams, but a clue is that the King's device will not send out an identifying (IFF) signal.

Game features include:

Fully hosted (requires hosting/joining) and supports post-game debriefing 2 or 3 Teams. Up to 8 players on each team Team Tags (selectable)—Yes (Y) or No (N) (default=Y)

Medic Mode (selectable)—Yes (Y) or No (N) (default=Y)

Time—1-99 minutes (default=15 min for 2-KINGS, and 30 min for 3-KINGS)

Reloads—0-99 or Unlimited (default=20)

Mega-Tags—0-99 or Unlimited (default=00)

Shields—0-99 seconds (default=30)

Tags—1-99 (default=15)

Ranking is individual and team:

Zone Games—in Zone games the host's device becomes the Zone TAGGER. The Zone TAGGER does not participate in the game as a player although it still performs all set-up and programming functions and performs the debriefing at the end of the game. The Zone TAGGER creates the Zone by generating a 360° infrared light field using its omnidirectional transceiver. The Zone TAGGER should always be stationary during a game and positioned on a stable surface with the omnidirectional transceiver pointing straight up and level with the ground. The Zone TAGGER should be located in a place so that the Zone can fill a large area without obstructions that may create dead spots within the Zone.

All devices in the game operate to sense the Zone using their omnidirectional transceivers. Devices accumulate "Zone Time" whenever the device can sense the Zone and multiple players may be in the Zone at the same time. A player may remain in the Zone as long as he/she is not "Neutralized." When a player takes a tag from any other player, whether he/she is in the Zone or not, the tagged player becomes "Neutralized" for 15 seconds. The neutralized device will display "NEUT" on the device display and a fifteen-second countdown. A neutralized player cannot tag other players, be tagged by other players, raise shields or add Mega-Tag power. A neutralized player must leave the Zone within 5 seconds of being tagged and remain completely out of the Zone while neutralized. If a player stays in the Zone or returns to the Zone while neutralized, the Zone will become "hostile" to that neutralized player. A hostile Zone will cause a player's device to take multiple tags from the Zone at a pace fast that may completely tag out the neutralized player from the game within just a few seconds.

OWN THE ZONE (OWNZ)—The object of the game is to accumulate as much Zone Time as possible. Own the Zone is a strategic individual game where all players are opponents. Players should focus on getting into and staying in the Zone as long as possible without getting tagged, rather than attacking the opponents. The player with most Zone Time wins the game. It should be noted that multiple players can be in the Zone at the same time, as long as they can avoid getting tagged.

Game features include:

Fully hosted (requires hosting/joining) and supports post-game debriefing 2-24 players No Teams. All players are opponents Time—1-99 minutes, (default=10 min)

Reloads—0-99 or Unlimited (default=15)

Mega-Tags—0-99 or Unlimited, (default=0)

Shields—0-99 seconds (default=45)

Tags—1-99 (default=10)

Ranking is individual only

2-TEAMS OWN THE ZONE (2TOZ) and 3-TEAMS OWN THE ZONE (3TOZ)—The object of the game is to accumulate as much collective Zone Time as possible for the whole team. These two games are played in the same way as the Individual game of Own the Zone except that the players are divided into teams.

Game features include:

Fully hosted, (requires hosting/joining) and supports post-game debriefing 2 or 3 Teams. Up to 8 players on each team Team Tags—Yes (Y) or No (N) (default=Y)

Time—1-99 minutes, (default=15 min for 2-TEAMS OWN THE ZONE, and 20 min for 3-TEAMS OWN THE ZONE)

Reloads—0-99 or Unlimited (default=15)

Mega-Tags—0-99 or Unlimited, (default=0)

Shields—0-99 seconds (default=45)

Tags—1-99 (default=10)

Score ranking is Individual and Team

While the present invention has been illustrated by a description of various embodiments and while these embodiments have been set forth in considerable detail, it is intended that the scope of the invention be defined by the appended claims. It will be appreciated by those skilled in the art that modifications to the foregoing preferred embodiments may be made in various aspects. It is deemed that the spirit and scope of the invention encompass such variations to be preferred embodiments as would be apparent to one of ordinary skill in the art and familiar with the teachings of the present application.

What is claimed is:

1. A hand-held device for an infrared shooting game having two or more participants, the device comprising:

a shaped housing for being handled by one of said two or more participants for shooting during the infrared shooting game;

a directional infrared transceiver disposed within the housing for transmitting directional IR data using a narrow light beam and receiving IR data using a narrow field of view IR receiver; and a omnidirectional infrared transceiver disposed within the housing for transmitting IR data using a wide angle light beam and wide angle field of view receiver.

2. The device of claim 1 wherein the directional infrared transceiver further comprises:

an infrared source coupled with the directional infrared transceiver, the infrared source including a collimating lens and an infrared light emitting diode disposed behind the collimating lens; and an infrared detector coupled with the directional infrared transceiver, the infrared detector including an infrared photodetector disposed behind the collimating lens to collimate transmitted and received light.

3. The device of claim 1 wherein the directional infrared transceiver further comprises:

an infrared source coupled with the directional infrared transceiver, the infrared source including a first collimating lens and an infrared light emitting diode disposed behind the first collimating lens; and an infrared detector coupled with the directional infrared transceiver, the infrared detector including a second collimating lens and an infrared photodetector disposed behind the second collimating lens.

4. The device of claim 1 wherein the omnidirectional infrared transceiver further comprises:

a first lens;

an omnidirectional infrared source comprising an infrared light emitting diode arranged with the first lens;

a second lens; and an omnidirectional infrared detector comprising an infrared light detector arranged with the second lens.

5. The device of claim 1 wherein the omnidirectional infrared transceiver further comprises:

an infrared source coupled with the omnidirectional infrared transceiver, the infrared source including an arrangement of two or more infrared light emitting diodes; and an infrared detector coupled with the omnidirectional infrared transceiver, the infrared detector including an arrangement of two or more infrared light detectors.

6. The device of claim 1 further comprising an interactive user interface including a keypad and a display screen to show user selectable game parameters, said keypad allowing user selection of game parameters.

7. The device of claim 1 further comprising an apparatus removably coupled to the device and adapted for wearing on the head of a device user, the apparatus including a transparent eyepiece having a see-through display, the display facilitating viewing of game information.

8. The device of claim 3 wherein the housing includes a barrel portion, the first and second collimating lenses disposed adjacently within the barrel portion such that the infrared source and the infrared detector are oriented parallel to each other along the barrel portion.

9. The device of claim 5 wherein the housing comprises a barrel portion having a generally hemispherical dome adapted to house the arrangements of infrared light emitting diodes and light detectors.

10. The device of claim 6 wherein the interactive user interface includes a selection screen to host or join a game.

11. The device of claim 6 wherein the user interface includes selection screens to adjust one or more gameplay parameters selected from the group consisting of game type, game time, number of tags to transmit, number of tags received until out tagged out, number of shields, shielded time and number of teams.

12. The device of claim 6 wherein display screen having indicia relative to one or more of: receipt of an acknowledgement signal from a remote game participant; receipt of a long-range signal from a remote game participant; receipt of a short-range identifying signal from a remote game participant; and receipt of a short-range identifying signal from a local game participant.

13. The device of claim 7 wherein the display includes indicia relative to one or more of: receipt of an acknowledgement signal from a remote game participant; receipt of a long-range signal from a remote game participant; receipt of a short-range identifying signal from a remote game participant; and receipt of a short-range identifying signal from a local game participant.

14. The device of claim 7 wherein the display comprises an optical combiner.

15. The device of claim 14 wherein the combiner comprises a partial mirror.

16. A hand-held device for an infrared shooting game having two or more participants, the device comprising:

a shaped housing for being handled by one of said two or more participants for shooting during the infrared shooting game;

a directional infrared transceiver;

an omnidirectional infrared transceiver;

a visual display coupled with said shaped housing; and said omnidirectional infrared transceiver emitting a continual identifying signal, said directional infrared transceiver receiving identifying signal, and said visual display indicating when hand held device receives identifying signal.

17. The device of claim 16 wherein identifying signal represents an area signature.

18. The device of claim 16 wherein the directional infrared transceiver further comprises:

an infrared source coupled with the directional infrared transceiver, the infrared source including a collimating lens and an infrared light emitting diode disposed behind the collimating lens; and an infrared detector coupled with the directional infrared transceiver, the infrared detector including an infrared photodetector disposed behind the collimating lens to collimate transmitted and received light.

19. The device of claim 16 wherein the directional infrared transceiver further comprises:

an infrared source coupled with the directional infrared transceiver, the infrared source including a first collimating lens and an infrared light emitting diode disposed behind the first collimating lens; and an infrared detector coupled with the directional infrared transceiver, the infrared detector including a second collimating lens and an infrared photodetector disposed behind the second collimating lens.

20. The device of claim 16 wherein the omnidirectional infrared transceiver further comprises:

a first lens;

an omnidirectional infrared source comprising an infrared light emitting diode arranged with the first lens;

a second lens; and an omnidirectional infrared detector comprising an infrared light detector arranged with the second lens.

21. The device of claim 16 wherein the omnidirectional infrared transceiver further comprises:

an infrared source coupled with the omnidirectional infrared transceiver, the infrared source including an arrangement of two or more infrared light emitting diodes; and an infrared detector coupled with the omnidirectional infrared transceiver, the infrared detector including an arrangement of two or more infrared light detectors.

22. The device of claim 19 comprising a housing having a barrel portion, the first and second collimating lenses disposed adjacently within the barrel portion such that the infrared source and the infrared detector are oriented parallel to each other along the barrel portion.

23. The device of claim 21 comprising a housing having a barrel portion having a generally hemispherical dome adapted to house the arrangements of infrared light emitting diodes and light detectors.

24. A hand-held device for an infrared shooting game having two or more participants, the device comprising:

a shaped housing for being handled by one of said two or more participants for shooting during the infrared shooting game;

a plurality of infrared transceiver channels facilitating communications between said two or more participants with said shaped housing for shooting during the infrared shooting game;

an omnidirectional infrared receiver;

an omnidirectional infrared transmitter;

an interactive user interface coupled with said shaped housing comprising, a keypad, and a visual display screen to show user selectable game parameters, said keypad allowing user selection of game parameters; and said omnidirectional infrared transmitter emitting a continual identifying signal, said omnidirectional infrared receiver receiving the identifying signal and further for receiving a joining signal from a joining device in response, with said visual display indicating when hand held device receives identifying signal.

25. The device of claim 24 wherein said interactive user interface with said omnidirectional infrared transmitter transmits the game characteristics and rules to the joining device and assigning the joining device a unique identification code, with the unique identification code comprising one or more of a device ID and a team ID.

26. The device of claim 24 wherein said omnidirectional infrared transmitter emits the identifying signal by transmitting an omnidirectional infrared broadcast signal from the host for inviting the devices other than the host to join the game where the identifying signal representing an area signature.

27. The device of claim 24 further comprising:

a plurality of joiner gun devices;

said plurality of infrared transceiver channels facilitating communications between the guns wherein said omnidirectional infrared transmitter emits the identifying signal by transmitting an omnidirectional infrared broadcast signal from the host for inviting the plurality of joiner gun devices other than the host to join the game; and said interactive user interface defines the gameplay of a game and registers at least one of the plurality of joiner gun to the game.

28. The device of claim 27 wherein the plurality of infrared channels comprises at least two receive channels and at least two transmit channels.

29. The device of claim 28 wherein the at least two receive channels comprise a directional receive channel and an omnidirectional receive channel, and the at least two transmit channels comprise a directional transmit channel and an omnidirectional transmit channel.

30. The device of claim 29 wherein the at least two infrared transceivers comprise a directional transceiver and an omnidirectional transceiver and wherein the identifying signal represents an area signature.

31. A hand-held device for an infrared shooting game having two or more participants, the device comprising:

a shaped housing for being handled by one of said two or more participants for shooting during the infrared shooting game;

a directional infrared transceiver disposed within the housing for transmitting directional IR data using a narrow light beam and receiving IR data using a narrow field of view IR receiver, the directional infrared transceiver comprising:

an infrared source coupled with the directional infrared transceiver, the infrared source including a collimating lens and an infrared light emitting diode disposed behind the collimating lens, and an infrared detector coupled with the directional infrared transceiver, the infrared detector including an infrared photo detector disposed behind the collimating lens to collimate transmitted and received light; and a omnidirectional infrared transceiver disposed within the housing for transmitting IR data using a wide angle light beam and wide angle field of view receiver, the omnidirectional infrared transceiver comprising:

a first lens, an omnidirectional infrared source comprising an infrared light emitting diode arranged with the first lens, a second lens, and an omnidirectional infrared detector comprising an infrared light detector arranged with the second lens.

32. The device of claim 31 wherein the housing comprises a barrel portion, the first and second collimating lenses disposed adjacently within the barrel portion such that the infrared source and the infrared detector are oriented parallel to each other along the barrel portion.

33. The device of claim 31 further comprising an interactive user interface including a keypad and a display screen to show user selectable game parameters, said keypad allowing user selection of game parameters.

34. The device of claim 31 further comprising an apparatus removably coupled to the device and adapted for wearing on the head of a device user, the apparatus including a transparent eyepiece having a see-through display, the display facilitating viewing of game information, wherein the display includes indicia relative to one or more of: receipt of an acknowledgement signal from a remote game participant; receipt of a long-range signal from a remote game participant; receipt of a short-range identifying signal from a remote game participant; and receipt of a short-range identifying signal from a local game participant.

35. A hand-held device for an infrared shooting game having two or more participants, the device comprising:

a shaped housing for being handled by one of said two or more participants for shooting during the infrared shooting game;

a directional infrared transceiver disposed within the housing for transmitting directional IR data using a narrow light beam and receiving IR data using a narrow field of view IR receiver, the directional infrared transceiver comprising:

an infrared source coupled with the directional infrared transceiver, the infrared source including a first collimating lens and an infrared light emitting diode disposed behind the first collimating lens, an infrared detector coupled with the directional infrared transceiver, the infrared detector including a second collimating lens and an infrared photodetector disposed behind the second collimating lens; and a omnidirectional infrared transceiver disposed within the housing for transmitting IR data using a wide angle light beam and wide angle field of view receiver, the omnidirectional infrared transceiver comprising:

an infrared source coupled with the omnidirectional infrared transceiver, the infrared source including an arrangement of two or more infrared light emitting diodes, and an infrared detector coupled with the omnidirectional infrared transceiver, the infrared detector including an arrangement of two or more infrared light detectors.

36. The device of claim 35 wherein the housing comprises a barrel portion having a generally hemispherical dome adapted to house the arrangements of infrared light emitting diodes and light detectors.

37. The device of claim 35 wherein the housing comprises a barrel portion, the first and second collimating lenses disposed adjacently within the barrel portion such that the infrared source and the infrared detector are oriented parallel to each other along the barrel portion.

* * * * *